US012467215B2

(12) United States Patent
Condello

(10) Patent No.: US 12,467,215 B2
(45) **Date of Patent: *Nov. 11, 2025**

(54) SNOW PLOW CUTTING EDGE DEVICE AND CUTTING EDGE ATTACHMENTS

(71) Applicant: Northern Supply II, Inc., Bloomfield, NY (US)

(72) Inventor: Kelly Condello, Bloomfield, NY (US)

(73) Assignee: Northern Supply II, Inc., Bloomfield, NY (US)

( * ) Notice: Subject to any disclaimer, the term of this patent is extended or adjusted under 35 U.S.C. 154(b) by 805 days.

This patent is subject to a terminal disclaimer.

(21) Appl. No.: 17/721,888

(22) Filed: Apr. 15, 2022

(65) Prior Publication Data

US 2023/0076022 A1 Mar. 9, 2023

Related U.S. Application Data

(63) Continuation-in-part of application No. 17/480,460, filed on Sep. 21, 2021, now Pat. No. 11,326,316.

(60) Provisional application No. 63/241,245, filed on Sep. 7, 2021.

(51) Int. Cl.
*E01H 5/06* (2006.01)

(52) U.S. Cl.
CPC ..... *E01H 5/066* (2013.01)

(58) Field of Classification Search
CPC E01H 5/066; E01H 5/065; E01H 5/06; E01H 5/061; E01H 5/062; E01H 5/063
See application file for complete search history.

(56) References Cited

U.S. PATENT DOCUMENTS

| | | | | |
|---|---|---|---|---|
| 4,944,104 | A * | 7/1990 | Kowalczyk | E01H 5/06 37/231 |
| 5,636,458 | A * | 6/1997 | Drake | E01H 5/066 37/270 |
| 7,101,709 | B2 | 9/2006 | Weiss et al. | |
| 7,467,485 | B2 | 12/2008 | Lachance et al. | |
| 7,631,441 | B2 * | 12/2009 | Hunt | E01H 5/061 37/232 |
| 9,611,604 | B2 * | 4/2017 | Vigneault | E01H 5/063 |
| 10,865,533 | B2 * | 12/2020 | Stephan | E01H 5/062 |
| 10,865,534 | B2 * | 12/2020 | Martin | E01H 5/066 |

(Continued)

OTHER PUBLICATIONS

DionCo Sales "Valley Blades Polar Flex"; Retrieved from: www.dioncosales.com/Polar-Flex.html (3 pages).

*Primary Examiner* — Jamie L Mcgowan
(74) *Attorney, Agent, or Firm* — Woods Oviatt Gilman LLP; Dennis B. Danella, Esq.

(57) ABSTRACT

A snow plow blade attachment includes a blade retainer, springs, and blade. The blade retainer includes a front plate, back plate, and bushings insertable through holes defined in the front plate and back plate. The blade includes elongated openings for receiving the bushings, a top edge having notches for receiving springs, and a bottom edge. The blade retainer secures the blade to an adapter plate using fasteners inserted through the bushings, the elongated openings of the blade, and holes defined in the adapter plate. The springs are disposed between the notches and a top portion of the blade retainer in a manner to bias the blade toward the road surface. The blade moves vertically as the bushings travel within the elongated openings when an upward force is applied to the blade.

30 Claims, 18 Drawing Sheets

(56) References Cited

U.S. PATENT DOCUMENTS

| | | | | |
|---|---|---|---|---|
| 11,124,935 | B2 * | 9/2021 | Martin | E01H 5/066 |
| 11,326,316 | B1 * | 5/2022 | Condello | E01H 5/066 |
| 2007/0245600 | A1 | 10/2007 | Hamel | |
| 2015/0376850 | A1 * | 12/2015 | Giletta | E01H 5/063<br>37/233 |
| 2017/0121921 | A1 * | 5/2017 | Herbon | E01H 5/02 |
| 2018/0327989 | A1 * | 11/2018 | Stephan | E01H 5/066 |
| 2019/0136473 | A1 * | 5/2019 | Desrochers | E01H 5/061 |
| 2019/0177939 | A1 * | 6/2019 | Guggino | E01H 5/06 |
| 2019/0203436 | A1 * | 7/2019 | Martin | E01H 5/066 |

* cited by examiner

SNOW PLOW CUTTING EDGE DEVICE AND CUTTING EDGE ATTACHMENTS

CROSS-REFERENCE TO RELATED APPLICATIONS

This application is a continuation-in-part of U.S. patent application Ser. No. 17/480,460, filed Sep. 21, 2021, which claims the benefit of U.S. Patent Application No. 63/241,245, filed Sep. 7, 2021, the contents of which are hereby incorporated in their entirety.

FIELD OF THE INVENTION

The present invention generally relates to a cutting edge attachment for snow and ice removal, and more particularly to a snow plow cutting edge device including a plurality of cutting edge attachments that may be mounted to a snow plow. In addition, the present invention generally relates to a blade attachment for snow and ice removal, and more particularly to a snow plow cutting edge device including a plurality of blade attachments that may be mounted to a snow plow. The present invention also relates to a blade retainer of the blade attachment, and optional modifications to the blade of the blade attachment.

BACKGROUND OF THE INVENTION

Traditional snow plows have a fixed edge that operates to scrape the road surface to remove snow and ice from the road to provide improved road conditions. A fixed blade arrangement has certain drawbacks in that it provides a straight bottom edge to move the snow material from the road, but in practice does not perform well because road surfaces are not typically flat. Roads are oftentimes designed with cambered surfaces to provide for drainage, and over time, settle in certain spots due to the repeated weight imposed in the road by vehicle travel. Moreover, road surfaces also have manholes, utility lids, or other obstacles in the road which leads to sub-par snow material from the road. When snow remains on the road, municipalities are forced to use salt to clear the roads of the snow material that is left behind by the snow plows, which has a negative environmental effect on the local water table, streams and lakes. Uneven road surfaces not only result in sub-par snow material from the road, but also subject cutting edge arrangements to extensive wear and tear. Repair or replacement of worn cutting edges or entire snow plows can be costly. To address these issues, there are certain devices that are attached to the bottom edge of a snow plow that attempt to provide for some uneven surfaces in the road. However, some of these existing systems are either not effective at conforming to the road surface, are complicated mechanical devices, or are difficult to install or maintain.

Thus, what is needed is a snow plow cutting edge device where each of the cutting edge attachments are independently removable and replaceable, can be easily installed without modifying existing snow plows, moldboards and/or vehicles, and can operate to retract and contour to variable road surfaces independently of the other cutting edge attachments along the length of the snow plow.

SUMMARY OF THE INVENTION

In one aspect, the present invention addresses the above needs by providing a snow plow cutting edge device for use with a snow plow, wherein the snow plow includes a moldboard, the snow plow cutting edge. The cutting edge device comprises an adapter plate configured to mount to the moldboard of the snow plow, wherein the adapter plate includes a plurality of apertures defined therein. The cutting edge device further comprises a plurality of cutting edge attachments and a plurality of fasteners for attaching each of the plurality of cutting edge attachments to the adapter plate. Each of the cutting edge attachments include a cover retaining plate, a plurality of springs, and a cutting edge. Each of the cutting edge attachments includes a cover retaining plate, a plurality of springs, and a cutting edge. The cover retaining plate includes a back plate, a top edge extension, and a pair of through-hole bushings extending outward from the back plate. The cutting edge includes a pair of elongated openings defined therein, wherein each of the elongated openings receive one of the pair of through-hole bushings, wherein a plurality of notches are defined in a top edge of the cutting edge, wherein the cutting edge includes a bottom edge configured for engaging a road surface during operation of the snow plow. Each of the plurality of springs include a first end and a second end, wherein the first end is disposed in a corresponding one of the plurality of notches, and wherein the send end is disposed against the top edge extension of the cover retaining plate. Each of the plurality of fasteners are disposed in one of the pair of through-hole bushings and a corresponding one of the plurality of apertures defined in the adapter plate to secure the respective cutting edge attachment to the adapter plate. The pair of through-hole bushings are positioned within the corresponding elongated pair of elongated openings defined in the cutting edge so that the cutting edge is movably secured between the cover retaining plate and the adapter plate, and wherein the plurality of springs bias the cutting edge toward the road surface so that the bottom edge of the cutting edge maintains contact with the road surface.

In some example embodiments, the springs of a respective cutting edge attachment are configured to compress, and the cutting edge of the respective cutting edge attachment is configured to slidably move up and/or down or on a tilt independently of other cutting edges of other cutting edge attachments that are connected to the adapter plate.

In some example embodiments, the springs of a respective cutting edge attachment and the cutting edge of the respective cutting edge attachment are configured to be installed, removed, repaired, and/or replaced independently of other springs and other cutting edges of other cutting edge attachments that are connected to the adapter plate.

In some example embodiments, each of the cover retaining plates includes a first portion that is a flat plate, with holes through which the pair of through-hole bushings protrude outward from the back surface of the cover retaining plate, a second portion that is a bent or angled plate, including a flat middle section and an angled bottom section, with holes in the middle section through which the pair of through-holes protrude, and the top edge extension that is a flat thin plate that is arranged perpendicular to the first portion and the middle section of the second portion.

In some example embodiments, the top edge extension is integrated with the second portion, such that the top edge extension is a top section of the second portion, or the top edge extension is a separate and distinct plate relative to the first and second portions of the cover retaining plate.

In some example embodiments, the second portion of the cover retaining plate includes a first side extension that protrudes outwardly from the first end of the first portion of the cover retaining plate, and the top edge extension includes a second side extension that protrudes outwardly from the second end of the first portion.

In some example embodiments, the first side extension of the second portion is configured to overlap with the second side extension of the top edge extension of another cover retaining plate of another cutting edge attachment that is adjacent to the respective cutting edge attachment.

In some example embodiments, each of the plurality of notches have a similar configuration.

In some example embodiments, the top edge extension includes a bottom surface, and wherein the top edge extension includes a plurality of support posts extending downward from the bottom surface, and wherein each of the plurality of support posts are disposed in a corresponding one of the plurality of springs.

In some example embodiments, per cutting edge attachment, there are at least one inner spring and corresponding notch and at least two outer springs and corresponding notches, and the inner springs and corresponding notches may be the same as or different from the outer springs and corresponding notches.

Some other example embodiments provide a cutting edge attachment for connection to an adapter plate mountable to a moldboard of a snow plow, the cutting edge attachment including the cover retaining plate, the plurality of springs, and the cutting edge as described above.

Some other example embodiments provide a snow plow comprising the adapter plate and the plurality of cutting edge attachments as described above.

In another aspect, a cutting edge attachment for connection to an adapter plate mountable to a moldboard of a snow plow is provided. The cutting edge attachment comprises a cover retaining plate, a plurality of springs, and a cutting edge. The cover retaining plate includes a back plate, a top edge extension, and a pair of through-holes extending outward from the back plate. The plurality of springs each include a first end and a second end, wherein the first end of each of the plurality of springs is disposed against the top edge extension of the cover retaining plate. The cutting edge includes a pair of elongated openings defined therein, wherein each of the elongated openings receive one of the pair of through-hole bushings, The cutting edge further includes a top edge having a plurality of notches defined therein, wherein each of the plurality of notches receive the second end of one of the plurality of springs. The cutting edge further includes a bottom edge configured for engaging a road surface during operation of the snow plow. The pair of through-holes are configured for receiving a corresponding number of fasteners that operate to secure the cutting edge attachment to the adapter plate so that the cutting edge is movably secured between the cover retaining plate and the adapter plate. The plurality of springs operate to bias the cutting edge toward the road surface so that the bottom edge of the cutting edge maintains contact with the road surface.

In yet another aspect, a snow plow blade attachment for connection to an adapter plate mountable to a moldboard of a snow plow is provided. The snow plow blade attachment comprising a blade retainer, a plurality of springs, a blade, and first and second fasteners. The blade retainer includes a front plate, a back plate, a top plate extending between the front plate and the back plate, a first bushing associated with first and second apertures defined in the front plate and the back plate, respectively, and a second bushing associated with respective third and fourth apertures defined in the front plate and the back plate, respectively. Each of the plurality of springs include a first end and a second end, wherein the first end of each of the plurality of springs is disposed against the top plate of the blade retainer. The blade includes first and second elongated openings defined therein, wherein the first elongated opening is configured to receive the first bushing, and wherein the second elongated opening is configured to receive the second bushing. A top edge of the blade has a plurality of notches defined therein, wherein each of the plurality of notches are configured to receive the second end of a corresponding one of the plurality of springs. A bottom edge of the blade is configured for engaging a road surface during operation of the snow plow. The first and second fasteners are configured to be positioned in first and second bushings, respectively, to secure the blade attachment to the adapter plate so that the blade is movably secured between the front plate and the back plate of the blade retainer. The plurality of springs bias the blade toward the road surface so that the bottom edge of the blade maintains contact with the road surface.

In another aspect, a snow plow cutting edge device for use with a snow plow is provided, wherein the snow plow includes a moldboard. The cutting edge device comprises an adapter plate and a plurality of the snow plow blade attachments as set forth in the previous paragraph. The adapter plate is configured to mount to the moldboard of the snow plow, wherein the adapter plate includes a plurality of apertures defined therein. The plurality of snow plow blade attachments are installed in a side by side orientation along the adapter plate using a plurality of fasteners inserted through the apertures defined in the adapter plate and into the respective bushings of each blade retainer.

In yet another aspect, a blade retainer for a snow plow blade attachment for connection to an adapter plate mountable to a moldboard of a snow plow is provided. The blade retainer comprises a front plate including first and second apertures defined therein; a back plate including third and fourth apertures defined therein; a top plate extending between the front plate and the back plate; a first bushing associated with the first aperture and the third aperture, wherein the first bushing is configured for receiving a first fastener to secure the blade retainer to the adapter plate; and a second bushing associated with the second aperture and the fourth aperture, wherein the first bushing and the second bushing is configured for receiving first and second fasteners, respectively to secure the blade retainer to the adapter plate. The first and second bushings are configured to be disposed in respective first and second elongated slots defined in a blade, and the top plate is configured to support a plurality of springs disposed within corresponding notches defined in in the blade.

In another aspect, a blade for a snow plow blade attachment that is adapted to be connected to an adapter plate mountable to a moldboard of a snow plow is provided. The blade attachment includes a blade retainer including a front plate, a back plate, and a pair of bushings insertable through holes defined in the front plate and the back plate. The blade attachment further includes a plurality of springs, wherein each spring includes a first end and a second end, and wherein the first end of each of the plurality of springs is disposed against a top portion of the front plate of the blade retainer. The blade comprises a pair of elongated openings defined therein configured to receive one of the pair of bushings, wherein the pair of bushings are configured for receiving a corresponding number of fasteners that operate to secure the blade retainer to the adapter plate. The blade further includes a top edge having a plurality of notches defined therein, wherein each of the plurality of notches include a bottom surface and two opposing side surfaces, and wherein each of the plurality of notches are configured to receive the second end of a respective one of the plurality of springs. A bottom edge of the blade is configured for engaging a road surface during operation of the snow plow, wherein the springs bias the blade toward the road surface so that the bottom edge of the blade maintains contact with the road surface. Further, a nose piece extends from one side of the blade to catch spill over from the snow plow.

In yet another aspect, a snow plow blade attachment for connection to an adapter plate mountable to a moldboard of a snow plow is provided. The blade attachment comprises a blade retainer, a plurality of springs, and a blade. The blade retainer includes a front plate, a back plate, a top plate extending between the front plate and the back plate, and a pair of bushings insertable through holes defined in the front plate and the back plate. Each of the plurality of springs includes a first end and a second end, wherein the first end of each of the plurality of springs is disposed against a top plate of the front plate of the blade retainer. The blade comprises a pair of elongated openings defined therein, wherein each of the elongated openings are configured to receive one of the pair of bushings, and wherein the pair of bushings are configured for receiving a corresponding number of fasteners that operate to secure the blade retainer to the adapter plate. A top edge of the blade has a plurality of notches defined therein, wherein each of the plurality of notches include a bottom surface and two opposing side surfaces, wherein each of the plurality of notches are configured to receive the second end of a respective one of the plurality of springs. A bottom edge of the blade is configured for engaging a road surface during operation of the snow plow, wherein the springs bias the blade toward the road surface so that the bottom edge of the blade maintains contact with the road surface. Further, a nose piece extends from one side of the blade to catch spill over from the snow plow.

In another aspect, a blade for a snow plow blade attachment that is adapted to be connected to an adapter plate mountable to a moldboard of a snow plow is provided. The blade attachment includes a blade retainer including a front plate, a back plate, and a pair of bushings insertable through holes defined in the front plate and the back plate. The blade attachment further includes a plurality of springs, wherein each spring includes a first end and a second end, wherein the first end of each of the plurality of springs is disposed against a top portion of the front plate of the blade retainer. The blade comprises a front surface, a back surface, and a pair of elongated openings extending between the front surface and the back surface. Each of the elongated openings are configured to receive one of the pair of bushings, wherein the pair of bushings are configured for receiving a corresponding number of fasteners that operate to secure the blade retainer to the adapter plate. The blade further includes a top edge having a plurality of notches defined therein, wherein each of the plurality of notches include a bottom surface and two opposing side surfaces, and wherein each of the plurality of notches are configured to receive the second end of a respective one of the plurality of springs. A bottom edge of the blade is configured for engaging a road surface during operation of the snow plow, wherein the springs bias the blade toward the road surface. The blade further includes a pair of wing tips extending from the front surface of the blade to allow the blade to ride over obstacles protruding from the road surface.

Other objects and advantages of the present invention will become apparent from the following description taken in connection with the accompanying drawings, wherein is set forth by way of illustration and example, embodiments of this invention.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

The present invention is described below in enabling detail by the following examples, which may represent more than one example embodiment of the present invention.

Figure 1:
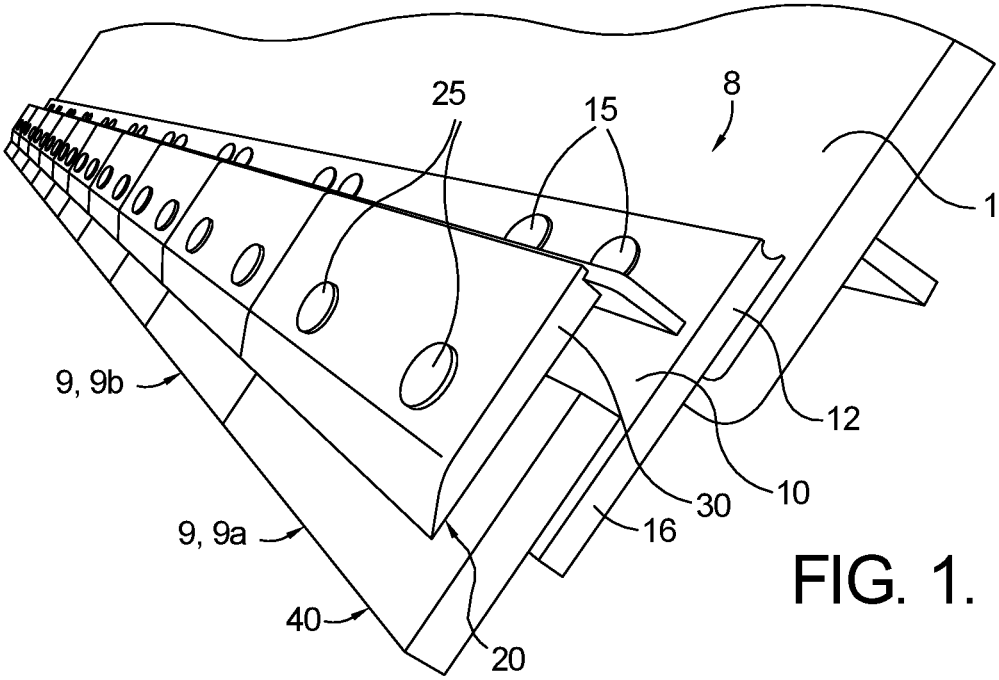
FIG. 1 is a front perspective view of a snow plow cutting edge device including a plurality of cutting edge attachments, according to an example embodiment.

Turning now to the drawings, with initial reference to FIG. 1, one exemplary embodiment of a snow plow cutting edge device including a plurality of cutting edge attachments is provided and is identified with reference numeral 8. As shown in FIG. 1, snow plow cutting edge device 8 includes an adapter plate 10 and a plurality of cutting edge attachments 9. Each cutting edge attachment 9 includes a cover retaining plate 20, springs 30, and a cutting edge 40.

In some example embodiments, adapter plate 10 is a single long rectangular plate. An upper portion 12 of adapter plate 10 has bolt holes 14 defined therein that are designed to align with bolt holes 4 (FIGS. 5-6) of a moldboard 1 of a snow plow configured for mounting on the front of a truck or other vehicle. The design and mechanisms for attachment of the moldboard 1 to the front end of the truck or other vehicle may be various standard means known in the industry. Bolts 15 may be inserted through bolt holes 14 in upper portion 12 of adapter plate 10 and bolt holes 4 of the moldboard 1 to mount adapter plate 10 to plow moldboard 1. A lower portion 16 of adapter plate 10 has bolt holes 18 defined therein that are designed to align with, or accept, bolt through-hole bushings 28 of cover retaining plate 20. Bolts 25 may be inserted through respective through-hole bushings 28 of cover retaining plate 20, elongated openings 48 of cutting edge 40, and bolt holes 18 in lower portion 16 of adapter plate 10 to attach cutting edge 40 to the adapter plate 10 via cover retaining plate 20. During assembly, the various bolts may be secured via nuts, washers, and other commonly used fastening means. Bolts may be the same sizes or different widths and/or lengths, as needed or desired for structural support, stability, and durability.

The length of adapter plate 10 may be designed to correspond to various standard sizes of snow plows, extending the entire length (or most) of moldboard 1 of the snow plow. In some other example embodiments, adapter plate 10 may comprise multiple plates in a row, so as to provide a modular design of varying lengths. Also refer to FIGS. 5-6, 10, and 12 regarding adapter plate 10.

For each cutting edge attachment 9 of snow plow cutting edge device 8, cover retaining plate 20 attaches or otherwise retains cutting edge 40 to adapter plate 10. The springs 30 allow each cutting edge 40 to slidably move generally perpendicularly to the road surface (or on a slight tilt/angle relative to the road surface) during operation to adjust to varying road conditions independently of other cutting edges 40 of the other cutting edge attachments 9 mounted to adapter plate 10. Additional details of cover retaining plate 20, springs 30, and cutting edge 40 will be described below with reference to FIGS. 2-4.

Figure 2:
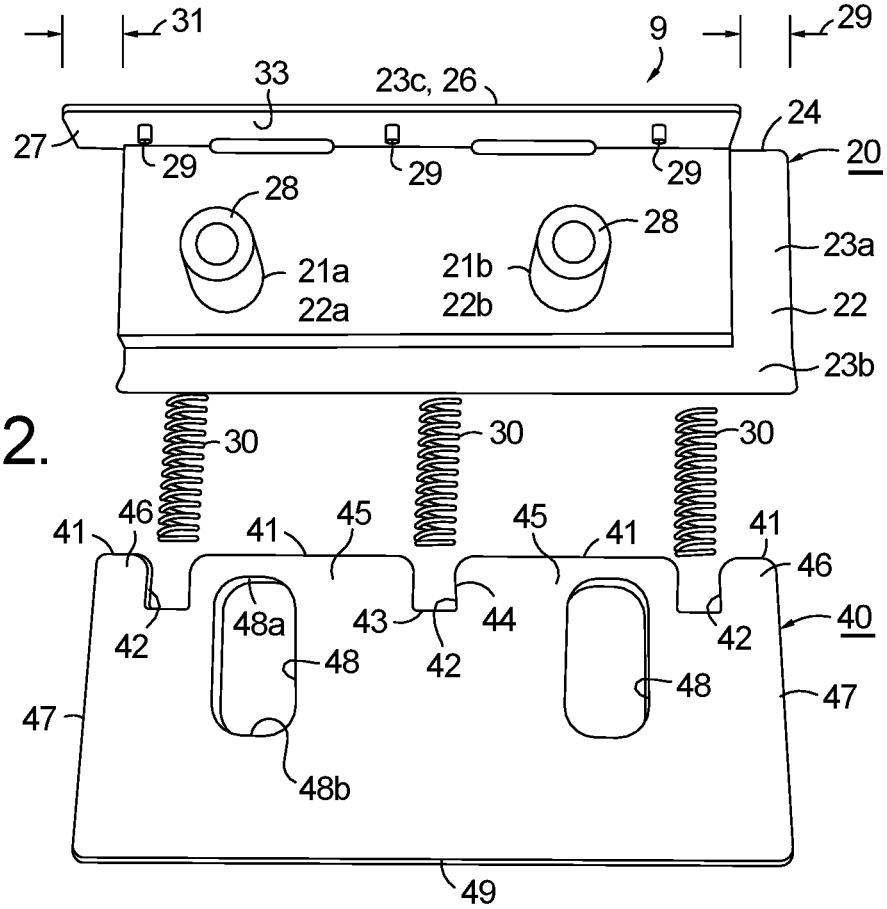
FIG. 2 is an exploded rear view showing disassembled components of a single cutting edge attachment, according to an example embodiment.

FIG. 2 is an exploded rear view showing disassembled components of a single cutting edge attachment, according to an example embodiment. As shown in FIG. 2 and mentioned above, each cutting edge attachment 9 includes cover retaining plate 20, springs 30, and cutting edge 40. Each of these elements, along with their arrangements and interactions with respect to each other, will be further described in detail below. Also refer to FIGS. 7-9 below for details of each element of the cutting edge attachments and their relationships to each other.

Cover retaining plate 20 secures or otherwise retains cutting edge 40 to the adapter plate 10, wherein cutting edge 40 is movably disposed between cover retaining plate 20 and adapter plate 10. The cover retaining plate 20 also holds the springs 30 in place once assembled, and during operation of the snow plow cutting edge device 8. The cover retaining plate 20 includes a first portion 21, a second portion 22, a third portion 26, and a pair of through-hole bushings 28. It should be understood that first and second portions 21, 22 may collectively be referred to herein as a back plate. First portion 21 may be a flat rectangular plate, with holes 21*a*, 21*b* through which pair of through-hole bushings 28 protrude outward from the back surface of the cover retaining plate 20, where the through-hole bushings 28 can receive bolts 25 during assembly of the snow plow cutting edge device 8.

Second portion 22 may be including a flat rectangular middle section 23*a* and an angled rectangular bottom section 23*b*, with holes 22*a*, 22*b* in middle section 23*a* through which through-hole bushings 28 protrude outward from the back surface of the cover retaining plate 20. The angle at which second portion 22 is bent to form middle section 23*a* and bottom section 23*b* may be diagonal (about 45 degrees, although this is non-limiting and the angle may be greater or less than 45 degrees). Bottom section 23*b* includes a distal edge that is angled toward, and positioned adjacent to or in contact with, cutting edge 40. This distal edge may operate to guide or otherwise maintain the path of travel of cutting edge 40 as it moves linearly between cover retaining plate 20 and adapter plate 10. Second portion 22 (middle section 23*a* and bottom section 23*b*) includes a top edge extension 24 that protrudes out a distance 29 from the side of the opposite side of the first portion 21 (right side in FIG. 2). Note that the opposite side of second portion 22 from extension 24 is flush with the opposite side of the first portion 21 (left side in FIG. 2).

Third portion 26 may be a flat rectangular plate that is arranged perpendicular to first portion 21 and middle section 23*a* of second portion 22. Third portion 26 includes an extension 27 that protrudes a distance 31 out from the side of first portion 21 and second portion 22 (left side in FIG. 2). Note that the opposite side of third portion 26 from extension 27 is flush with the opposite side of first portion 21 (right side in FIG. 2).

In some example embodiments, third portion 26 may be integrated with second portion 22. For example, middle section 23*a* of second portion 22, bottom section 23*b* of the second portion 22, and third portion 26 (which may also be considered a top edge extension 23*c* of second portion 22 in this example embodiment) may be formed by cutting out a section at the left side of middle section 23*a* and bottom section 23*b* of second portion 22 (so as to form a long rectangular vertical cutout or notch) and cutting out a section at the upper right corner of middle section 23*a* and third portion 26 (top section 23*a*)(so as to form a square or short rectangular cutout or notch), and then bending the single piece of metal at upper and lower portions to the appropriate or desired angles for bottom section 23*a* and third portion 26 (23*b*). The vertical distance between the two bends (the bend between bottom section 23*b* and middle section 23*a*, and the bend between top edge extension 23*c* and middle section 23*b*) corresponds to the vertical width of first portion 21, as shown in FIG. 2. Thus, first portion 21 may lay against middle section 23*a* of second portion 22, and bottom section 23*b* and third portion 26 (top edge extension 23*c*) may wrap around first portion 21 at diagonal and right angles, respectively. Second portion 22 may be welded to first portion 21 at or near the lower bend between middle section 23*a* and bottom section 23*b* of second portion 22, and third portion 26 (top edge extension 23*c*) may be welded to first portion 21 at or near the upper bend between middle section 23*a* and third portion 26 (top edge extension 23*c*), for example. Various known suitable attachment/fixing mechanisms for the components of cover retaining plate 20 other than welding are also possible, according to some other example embodiments.

However, in an alternative example embodiment, third portion 26 may be a separate and distinct metal plate welded to second portion 22 and/or first portion 21 at a right angle (about 90 degrees) so as to be attached perpendicular thereto. In this alternative example embodiment, there is no need to form the cutouts or notches in cover retaining plate 20 itself, and an opening corresponding to extension 24 of second portion 22 (extending past the right side of first portion 21) and an opening corresponding to extension 27 of third portion 26 (extending out past the left side of first portion 21 and second portion 22) are formed simply by the respective alignments of the individual pieces of cover retaining plate 20 including first portion 21, second portion 22, and third portion 26 when welding the pieces together (or otherwise attaching/fixing them to form cover retaining plate 20).

The extension 27 of third portion 26 (top edge extension 23*c*) of cover retaining plate 20 corresponds in size to and is designed to engage with a cutout or notch (or opening in the alternative embodiment above) on the side of an adjacent cutting edge attachment 9 of the snow plow cutting edge device 8. Likewise, the cutout or notch (or opening in the alternative embodiment above) above extension 24 of middle section 23*a* and bottom section 23*b* of cover retaining plate 20 corresponds in size to and is designed to engage with an extension of a third portion/top section on the side of an adjacent cutting edge attachment 9 of the snow plow cutting edge device 8.

Thus, each cover retaining plate 20 is design to partially overlap with adjacent cover retaining plates on either side when assembled into a row of a plurality of cutting edge attachments that are mounted to adapter plate 10. This can assist with easy alignment of the cutting edge attachments and bolt holes during assembly of the snow plow cutting edge device and provides for increased rigidity of snow plow cutting edge device 8 as a whole.

Third portion 26 (top edge extension 23*c*) also includes a plurality of support posts 29 extending down from a bottom surface 33 thereof that are designed to receive and maintain the position of springs 30. In particular, a top part of springs 30 slides over and around, and engages with, support posts 29, respectively. Support posts 29 are configured to secure springs 30 during assembly of the cutting edge attachments and prevent lateral movement of springs 30 during operation of the snow plow cutting edge device.

Springs 30 allow cutting edge 40 of each cutting edge attachment 9 to fluctuate with the road surface during operation of the snow plow cutting edge device 8. Springs 30 may be die springs or other similar CNC-machined compression springs, for example. Springs 30 may be formed using various kinds of metals as commonly known in the industry, and may have a cylindrical, squared, or rectangular shape, for example, with at least one open end (the top end corresponding to support posts 29). However, example embodiments are not limited thereto, and various other types of compression springs or other flexible spring-like mechanisms may be utilized. Alternatively, springs 30 may be made of flexible polymer or elastomer materials, for example. Springs 30 may have coils, or may be solid or molded, or may be rubberized hollow cylindrical or tube-like structures. Each spring 30 may be identical, but this is not required and some springs may have different lengths, widths, compressive strengths, shapes, or the like as compared to each other, to allow for varying degrees and forces required for retraction of cutting edge 40 during operation of the snow plow cutting edge device according to different design needs or desires. Also, springs 30 may be linear or constant rate springs, progressive or variable rate springs, dual or fast/soft rate springs, etc. Springs 30 may be standard off-the-shelf springs widely available and commonly used in the industry, or custom-designed components for different applications.

Although three springs 30 are shown in the figures, some other example embodiments are not limited thereto, and there may be a greater or lesser number of springs per cutting edge attachment. For example, there may be only two outer springs or a single inner spring, or there may be a pair in inner springs and a pair of outer springs. In the case of fewer than three springs the springs may be larger and/or may have more resistance, and in the case of more than three springs the springs may be smaller and/or may have less resistance. Example embodiments are not limited to the arrangements and dimensions of the springs as shown in the figures.

As mentioned above, the top part (open top end) of spring 30 slides over and around, and engages with, respective support post 29 extending downward from bottom surface 33 of third portion 26 (top edge extension 23*c*) of cover retaining plate 20. In addition, the bottom part (open bottom end) of spring 30 slides into, and engages with, a respective notch 42 defined in top edge 41 of cutting edge 40, as discussed in further detail below.

Cutting edge 40 is configured to engage with the road surface during operation of the snow plow cutting edge device 8. Cutting edge 40 includes a top edge 41 including notches 42 formed therein, a pair of side edges 47, a pair of elongated openings 48, and a bottom edge 49. Cutting edge 40 may be a relatively short segment of an entire cutting edge assembly for a snow plow, such as a 12 inch segment for example. Cover retaining plate 20 may similarly be a short segment (e.g., about 12 inches) of the entire cutting edge assembly, where each cutting edge attachment 9 includes one cover retaining plate 20 per one cutting edge 40. Thus, each cutting edge attachment 9 is roughly one foot in length, in a non-limiting illustrative example. However, example embodiments are not limited thereto, and each cutting edge 40 may be somewhat shorter or longer in the horizontal direction along the snow plow edge in modified designs. Similarly, example embodiments are not limited to the width of cutting edge 40 in the vertical direction as shown in the figures.

Top edge 41 of cutting edge 40 may be partially flat (or straight) in the horizontal direction, except for notches 42 formed in top edge 41 of cutting edge 40. Notches 42 may be a square or rectangular shape formed by cutting out small sections spaced along top edge 41. Notches 42 may thus include a flat bottom surface 43 and two flat side surfaces 44 that are designed to receive and support springs 30. The bottom part of spring 30 slides into notch 42 and engages with bottom surface 43 of notch 42 to secure spring 30 during assembly of cutting edge attachments 9, while side surfaces 44 of notch 42 prevent lateral movement of spring 30 during operation of the snow plow cutting edge device 8.

Although three notches 42 are shown in the figures, some other example embodiments are not limited thereto, and there may be a greater or lesser number of notches per cutting edge. For example, there may be only two outer notches or a single inner notch, or there may be a pair of inner notches and a pair of outer notches. In the case of fewer than three notches the notches may be wider to accommodate larger springs, and in the case of more than three notches the notches may be narrower to accommodate smaller springs. Example embodiments are not limited to the arrangements and dimensions of the notches as shown in the figures.

Notches 42 in top edge 41 also form inner extensions 45 and outer extensions 46, where inner extensions 45 may be wider/larger and the outer extensions 46 are narrower/smaller compared to each other. Top edge 41 of inner extensions 45 and top edge 41 of outer extensions 46 may lie along the same plane (they are flush or aligned with each other). Likewise, bottom surface 43 of inner notch 42 and the bottom surfaces 43 of outer notches 42 may lie along the same plane (they are flush or aligned with each other). However, other arrangements and dimensions of inner extensions and outer extensions are also possible (e.g., in the alternative embodiments where there are only one or two springs/notches, or where there are four or more springs/notches.

Side edges 47 may be flat (or straight) in the vertical direction in some example embodiments. However, in some other example embodiments, side edges 47 may slope slightly inward from bottom to top in order to reduce or limit friction between cutting edges when one cutting edge retracts more than an adjacent cutting edge, or the adjacent cutting edge does not retract, to adapt to an uneven road surface or other obstacle. This could also permit a slight diagonal rotation allowing one side of cutting edge 40 to move up or down slightly more than the opposite side of the cutting edge. Respective cutting edges 40 of adjacent cutting edge attachments may come into contact with each other once assembled and/or during operation, or there may be a slight gap therebetween to avoid or alleviate friction during movement or retraction of the cutting edge.

Figure 6:
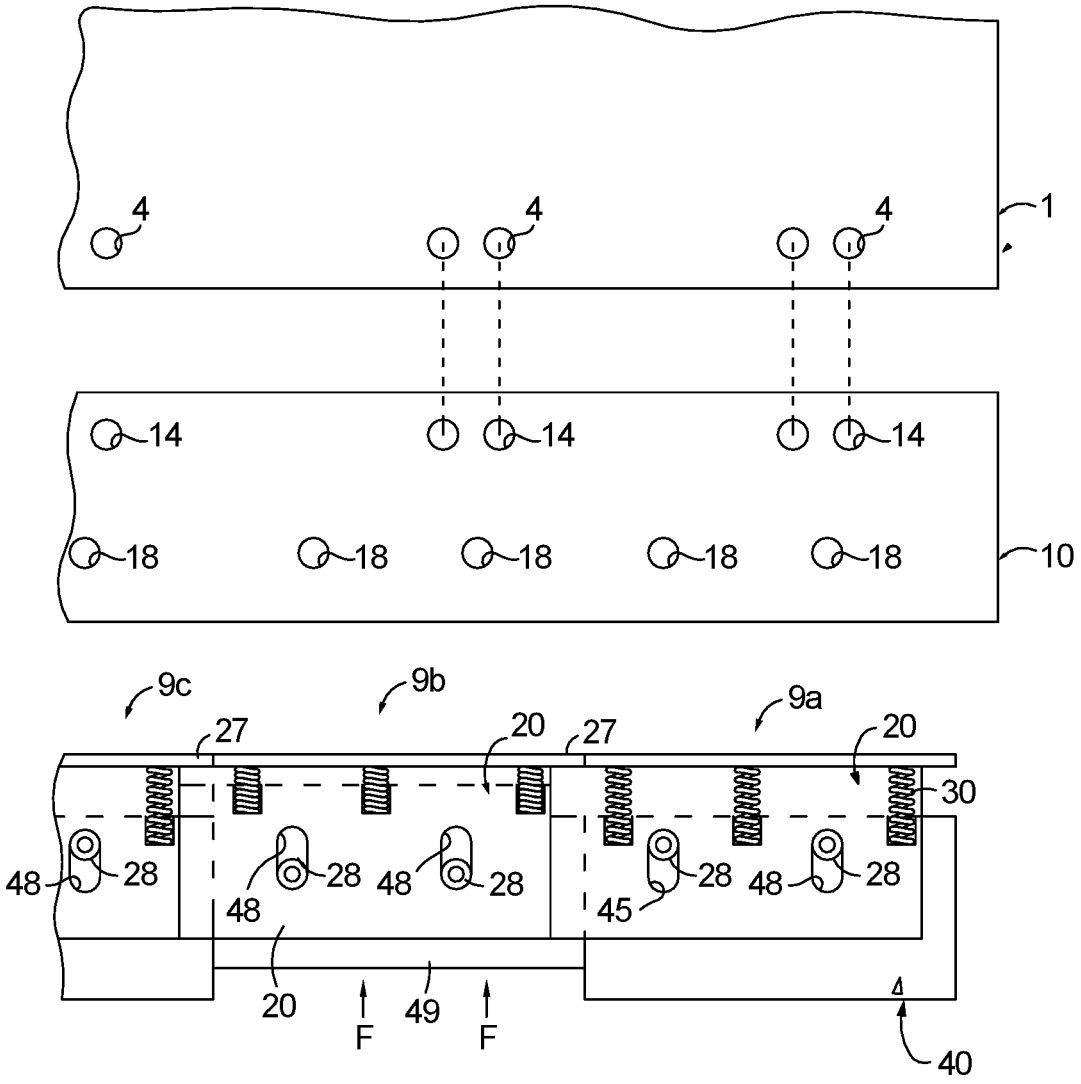
FIG. 6 is an exploded front view of a portion of a snow plow including a plurality of cutting edge attachments showing alignment of respective bolt holes of the adapter plate and cover retaining plate, with one cutting edge in a retracted state or position, according to an example embodiment.

The pair of elongated openings 48 are configured to receive the pair of through-hole bushings 28 of cover retaining plate 20, which are inserted through elongated openings 48 when assembled, in order to allow cutting edge 40 to slidably move up and down (either vertically or on a tilted angle relative to the road surface) guided by through-hole bushings 28 when upward force F is applied to bottom edge 49 of cutting edge 40 during operation (see FIG. 6). Elongated openings 48 define the vertical travel of cutting edge 40. Elongated openings 48 may have a vertical oval or rectangular shape (with or without rounded corners), as shown in FIG. 2.

In some example embodiments, downward movement of cutting edge 40 is limited when top surface 48*a* of elongated opening 48 contacts the through-hole bushing 28, and upward movement of cutting edge 40 is limited when bottom surface 48*b* of elongated openings 48 contacts through-hole bushing 28 (refer to FIGS. 3-4 and 6) during compression of spring 30 when an uneven road surface or other obstacle is encountered.

Further, downward and/or upward movement may be limited by the height and/or the compressive strength of springs 30 and/or the distance of travel between third portion 26 (top edge extension 23*c*) of cover retaining plate 20 and top edge 41 of cutting edge 40. For example, through-hole bushings 28 may or may not actually come into contact with bottom surface 48*b* of cutting edge 40 when an upward force F is applied to bottom edge 49 of cutting edge 40 so as to cause maximum retraction of cutting edge attachment 9. Likewise, top edge 41 of cutting edge 40 may or may not actually come into contact with bottom surface 33 of third part 26 (top edge extension 23*c*) of cover retaining plate 20 when an upward force F is applied to bottom edge 49 of cutting edge 40 so as to cause maximum retraction of the cutting edge attachment.

In some example embodiments, elongated openings 48 at least partially overlap with notches 42 in the vertical direction, as shown in FIG. 2. This is to ensure a more compact design compared to other existing flexible snow plow cutting edge devices. However, elongated openings 48 may overlap with notches 42 to a different or modified degree in some other example designs than shown in FIG. 2, to accommodate different sizes of springs and notches and/or different widths of the cutting edges.

Bottom edge 49 of cutting edge 40 may be flat (or straight) and is the portion of the cutting edge attachment that actually scrapes the snow and/or ice that has accumulated on the road surface during operation of the snow plow cutting edge device. Thus, cutting edge 40, and particularly bottom edge 49 thereof, is the component that is most susceptible to wear and damage over time, due to the various uneven road surfaces and other obstacles that the snow plow may encounter during normal operation.

To address this issue, the design and configuration of the cutting edge attachment 9 (including cover retaining plate 20, springs 30, and cutting edge 40) allows for quick and easy installation and removal as well as low cost repair and/or replacement of individual cutting edges 40, as the need arises. Further, springs 30 have a simple design and are individually replaceable if needed, and do not require a customized retraction mechanism such as flexible elastomeric means with non-standard shapes and/or different widths at different portions and/or different compressive strengths along the length thereof. Therefore, the cutting edge attachment according to example embodiments described herein provides numerous improvements over fixed cutting edges, non-modular designs, and complicated or custom-designed flexible mechanisms or components that may permit retraction of cutting edges in some form.

Also, the plurality of cutting edge attachments of the snow plow cutting edge device according to example embodiments described herein provide a further advantage over existing snow plow cutting edge devices in that the respective springs 30 of each cutting edge attachment can compress and expand independently of springs of other cutting edge attachments of the snow plow cutting edge device, such that each cutting edge can adapt independently to varying road conditions along the length of the snow plow moldboard 1 and adapter plate 10 as the snow plow encounters uneven road surfaces and other obstacles during normal operation.

Furthermore, the design of the snow plow cutting edge device allows each individual cutting edge attachment 9 to be removed and repaired or replaced if needed, as parts become worn or damaged. Similarly, each individual cover retaining plate 20 and/or each individual cutting edge 40 may be easily removed and replaced as needed (e.g., in 12 inch or sections of about one foot in length), without requiring any disassembly or replacement of the other cutting edge attachments and cutting edges of the snow plot cutting edge device (e.g., loosening or removing bolts of neighboring blade sections to pry out one section is not needed). Thus, the modular design of the cutting edge attachments 9 allows individual sections to easily and quickly be changed out without disturbing adjacent sections of the snow plow cutting edge device.

Figure 3:
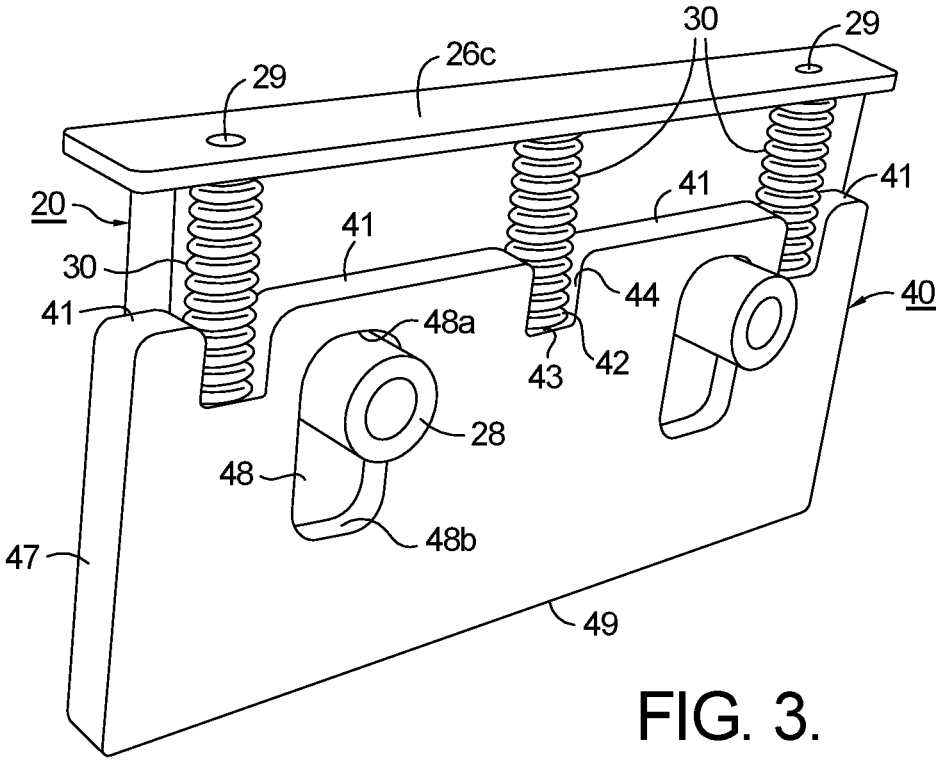
FIG. 3 is a rear perspective view of a single cutting edge attachment once assembled, according to an example embodiment.

FIG. 3 is a rear perspective view of a single cutting edge attachment 9 once assembled, according to an example embodiment. As shown in FIG. 3, springs 30 are in a decompressed state and through-hole bushings 28 of cover retaining plate 20 are in contact with top surface 48*a* of elongated openings 48 of cutting edge 40. The may be considered the default state or position of the cutting edge attachment, when no upward force F is being applied to bottom edge 49 of cutting edge 40.

As the cutting edge attachments encounter uneven road surfaces or other obstacles during normal operation of the snow plow cutting edge device, through-hole bushings 28 may slide within through-holes 28. Springs 30 may transition to a decompressed state and the through-hole bushings 28 of the cover retaining plate 20 may come into contact with bottom surface 48*b* of elongated openings 48 of cutting edge 40. This may be considered the maximum retraction state or position of the cutting edge attachment 9, when an upward force F is being applied to bottom edge 49 of cutting edge 40. FIG. 6 illustrates the retraction of one cutting edge 40 of an individual cutting edge attachment 9*a* relative to the non-retraction of adjacent cutting edges 40 of another other cutting edge attachment 9*b* of the snow plow cutting edge device 8. Also refer to FIG. 11 for another detailed view of the cutting edge attachment according to example embodiments.

Figure 4:
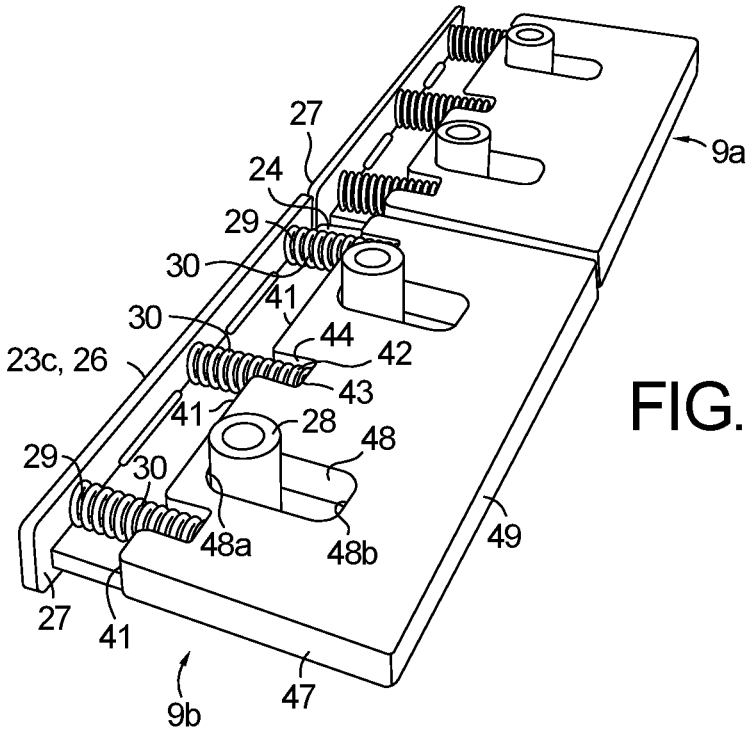
FIG. 4 is a rear perspective view of a pair of adjacent cutting edge attachments once assembled and aligned, according to an example embodiment.

FIG. 4 is a rear perspective view of a pair of adjacent cutting edge attachments 9 once assembled and aligned, according to an example embodiment. Similar to FIG. 3, FIG. 4 shows an assembled cutting edge attachment 9 but from a different angle. Additionally, FIG. 4 illustrates the modular design of the plurality of cutting edge attachments of the snow plow cutting edge device according to example embodiments described herein. A pair of adjacent cutting edge attachments 9 may partially overlap with each other when they are aligned, such as when being mounted to adapter plate 10 during installation. For example, first extension 27 of first cover retaining plate 20 of a first cutting edge attachment 9*a* overlaps with second extension 24 of a second cover retaining plate 20 of a second cutting edge attachment 9*b* that is aligned with an adjacent to the first cutting edge attachment 9*a*, and so on along the length of adapter plate 10 and snow plow moldboard 1 once all of the components of the snow plow cutting edge device 8 are mounted together. Thus, extension 27 of cover retaining plate 20 of one cutting edge attachment 9*a* may overlay a portion of cutting edge 40 (e.g., an outer extension 46 of a top edge 41) of another adjacent cutting edge attachment 9*b*. This overlapping cover retaining plate feature assists with installation and removal of the individual cutting edge attachments, for example. While FIGS. 2-4 show a rear view of the cutting edge attachments including cover retaining plate 20, springs 30, and cutting edge 40, also refer to FIGS. 5-6 for a front view of the assembled cutting edge attachments of FIGS. 2-4.

Figure 5:
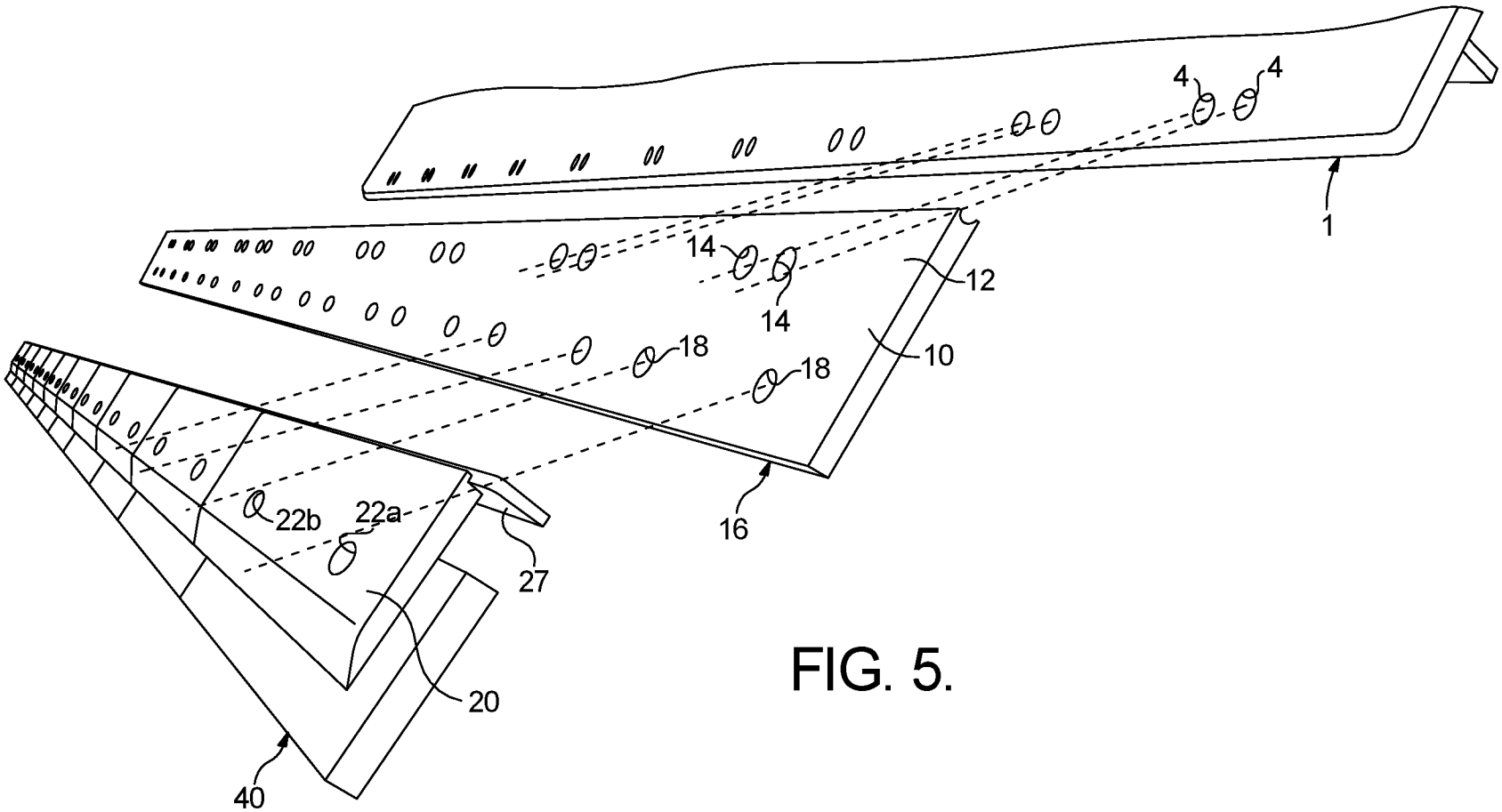
FIG. 5 is an exploded perspective view of a snow plow cutting edge device including a plurality of cutting edge attachments showing alignment of respective bolt holes of the adapter plate and the cover retaining plates of the cutting edge attachments, according to an example embodiment.

FIG. 5 is an exploded perspective view of a snow plow cutting edge device including a plurality of cutting edge attachments 9 showing alignment of respective bolt holes of the adapter plate and cover retaining plate, according to an example embodiment. FIG. 5 is similar to FIG. 1, but shows the cutting edge attachments 9 (including cover retaining plate 20, springs 30, and cutting edge 40) separated from adapter plate 10 and plow moldboard 1. The configuration of holes 4 in the moldboard 1 may be standard existing configurations, and holes 14 in adapter plate 10 may align with holes 4 to enable snow plow cutting edge device 8 according to example embodiments to be utilized without modification to moldboard 1 (as well as the rest of the snow plow not shown in the figures). The configuration of holes 18 in the adapter plate may align with the through-hole bushings 28 and elongated openings 48 to enable the individual cutting edge attachments according to example embodiments to be installed and removed independently of the other cutting edge attachments.

The distances between individual holes or pairs of holes (4/14) may be different from the distances between individual holes or pairs of holes (18/28/48). There may be a greater or lesser number of holes 4/14 and/or holes 18/28/48 total than shown in the figures (e.g., depending on how many cutting edge attachments are needed to correspond to the length of the existing snow plow moldboard 1 and the adapter plate 10). Also, there may be a greater or lesser number of holes 4/14 and/or holes 18/28/48 compared to each other than shown in the figures.

FIG. 6 is an exploded front view of a portion of a snow plow including a plurality of cutting edge attachments showing alignment of respective bolt holes of the adapter plate and the cover retaining plates of the cutting edge attachments, with one cutting edge in a retracted state or position, according to an example embodiment. FIG. 6 is similar to FIG. 5, showing the corresponding alignments of respective bolt holes of the various components of the snow plow cutting edge device from a different angle, but further shows cutting edge 40 of one of the cutting edge attachments in the retracted state or position, which is caused by an upward force F being exerted on the bottom edge 41 of cutting blade 40 (e.g., resulting from an uneven road surface or other obstacle in the road during normal operation).

Portions of the cutting edge attachments 9 that are obscured from the front view of FIG. 6, such as springs 30 and the majority of cutting edges 40 including top edge 41 and elongated openings 48, are shown with broken lines in FIG. 6 (refer to FIGS. 2-4). As shown in FIG. 6, springs 30 of one of the cutting edge attachments are compressed, and the position of top edge 41 and bottom edge 49 of cutting edge 40 of that cutting edge attachment 9*a* have moved upward in the vertical direction, compared to the respective components of the adjacent cutting edge attachments 9*b*, 9*c*. As mentioned above, movement of cutting edges 40 in the vertical direction may be controlled or limited when through-hole bushings 28 of the cover retaining plates 20 come into contact with bottom surface 48*b* and/or top surface 48*a* of the elongated openings 48 of cutting edges 40 as different forces are encountered on road surfaces during operation, for example.

Thus, each of cutting edges 40 of each individual cutting edge attachment are slidably movable, along through-hole bushings 28 within elongated openings 48, to and from the retracted state or position, independently of other cutting edges 40 of neighboring cutting edge attachments. Similarly, each set of springs 30 of each individual cutting edge attachment 9 are compressible independently of other sets of springs of neighboring cutting edge attachments. These features help the snow plow cutting edge device to be able to better adapt to varying road conditions with its modular cutting edge attachment design.

Furthermore, each cutting edge 40 and/or other components of the cutting edge attachments are installable/removable and repairable/replaceable independently of other cutting edge attachments 40 and components thereof. This helps to reduce maintenance time and lower costs, and thereby increase overall operator satisfaction with the improved snow plow cutting edge device.

Figure 7A:
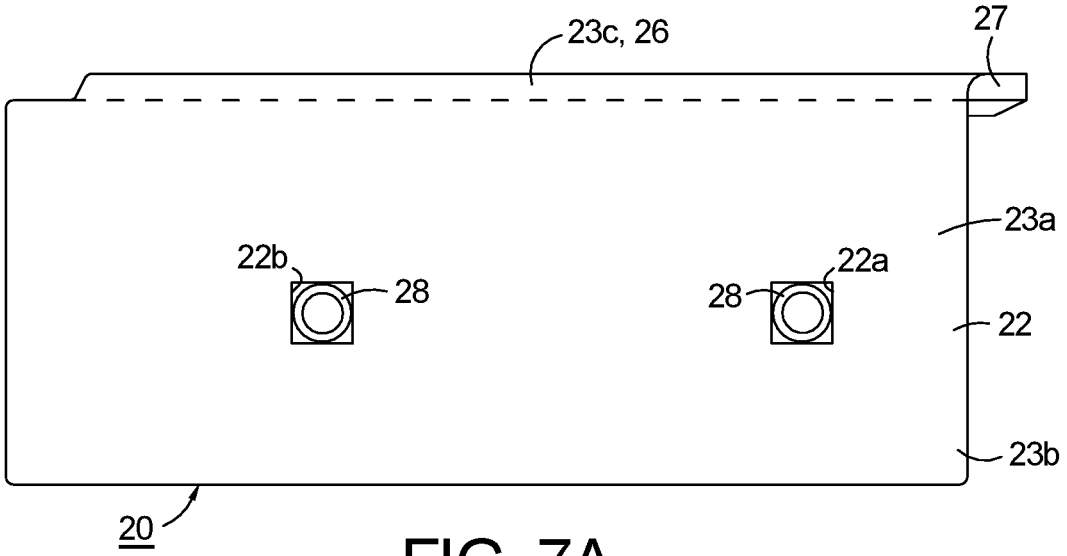
FIGS. 7A and 7B show a front view and a perspective view of the front side of the cover retaining plate of a cutting edge attachment, according to an example embodiment.
Figure 7B:
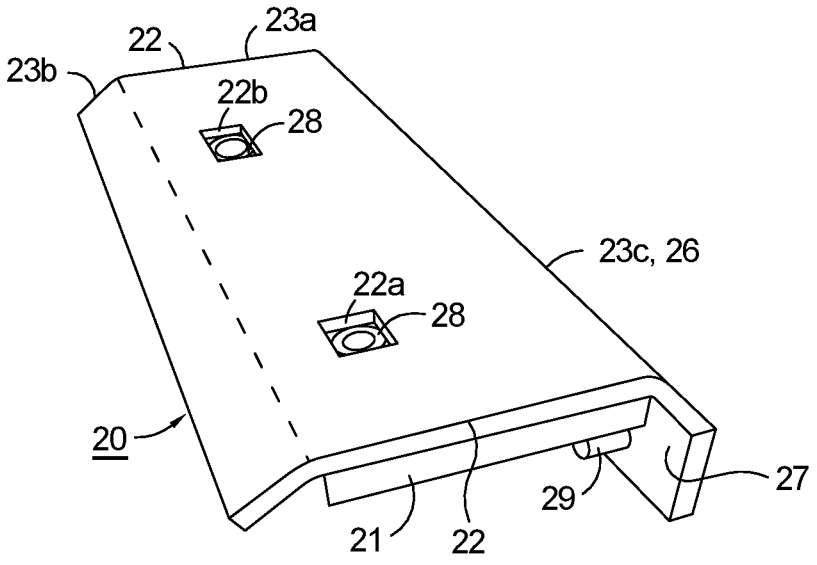

FIGS. 7A and 7B show a front view and a perspective view of the front side of the cover retaining plate of a cutting edge attachment, according to an example embodiment. As shown in FIGS. 7A and 7B, cover retaining plate 20 includes first portion 21, second portion 22 (including middle section 23*a* and bottom section 23*b*), and third portion 26 (or top edge extension 23*c*) including extension 27. First portion 21 and second portion 22 include bolt holes 21*a*, 21*b* and 22*a*, 22*b*, respectively. In some example embodiments, these bolt holes may form countersunk square holes for receiving the through-hole bushings 28, and preventing or limiting the heads of the through-hole bushings 28 from rotating or turning when fully inserted (such as when installing the corresponding bolts 25 into through-hole bushings 28 to attach cutting edge attachment 9 to adapter plate 10).

Figure 8A:
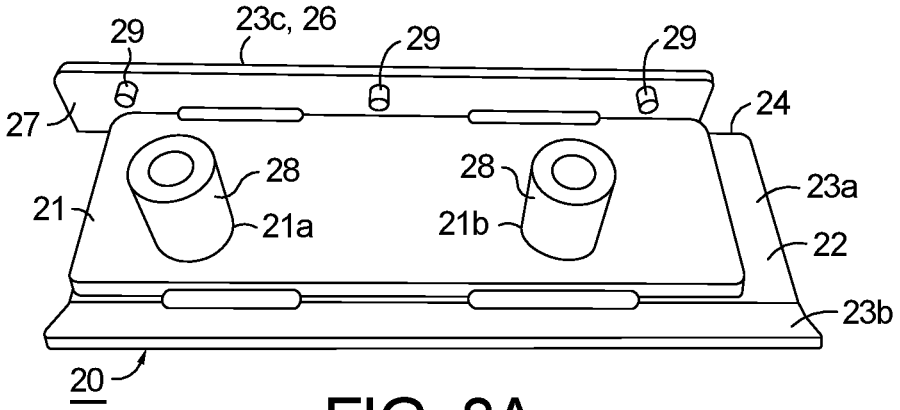
FIGS. 8A and 8B show a rear view and a perspective view of the back side of the cover retaining plate of a cutting edge attachment, according to an example embodiment.
Figure 8B:
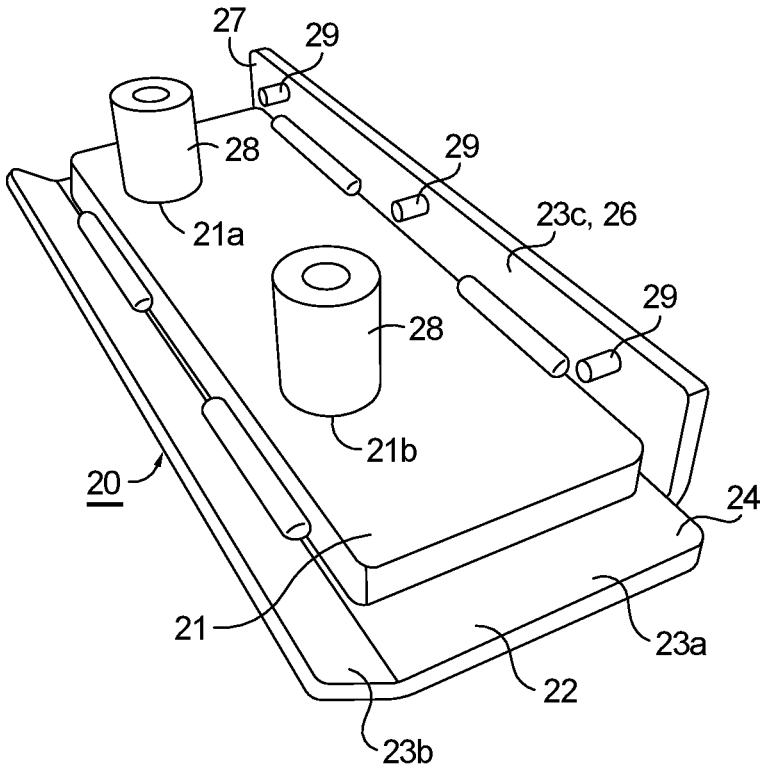

FIGS. 8A and 8B show a rear view and a perspective view of the back surface of the cover retaining plate of a cutting edge attachment, according to an example embodiment. As shown in FIGS. 8A and 8B, cover retaining plate 20 includes first portion 21, second portion 22 (including middle section 23*a* and bottom section 23*b*, forming extension 24), and third portion 26 (or top edge extension 23*c*) including extension 27. First portion 21, second portion 22, and third portion 26 may be welded together to form cover retaining plate 20. Through-hole bushings 28 are also shown inserted through bolt holes 22*a*, 22*b* of second portion 22 and bolt holes 21*a*, 21*b* of first portion 21. Third portion 26 (or top edge extension 23*c*) includes support posts 29 extending downward therefrom, for engaging with springs 30 when assembled.

Figure 9A:
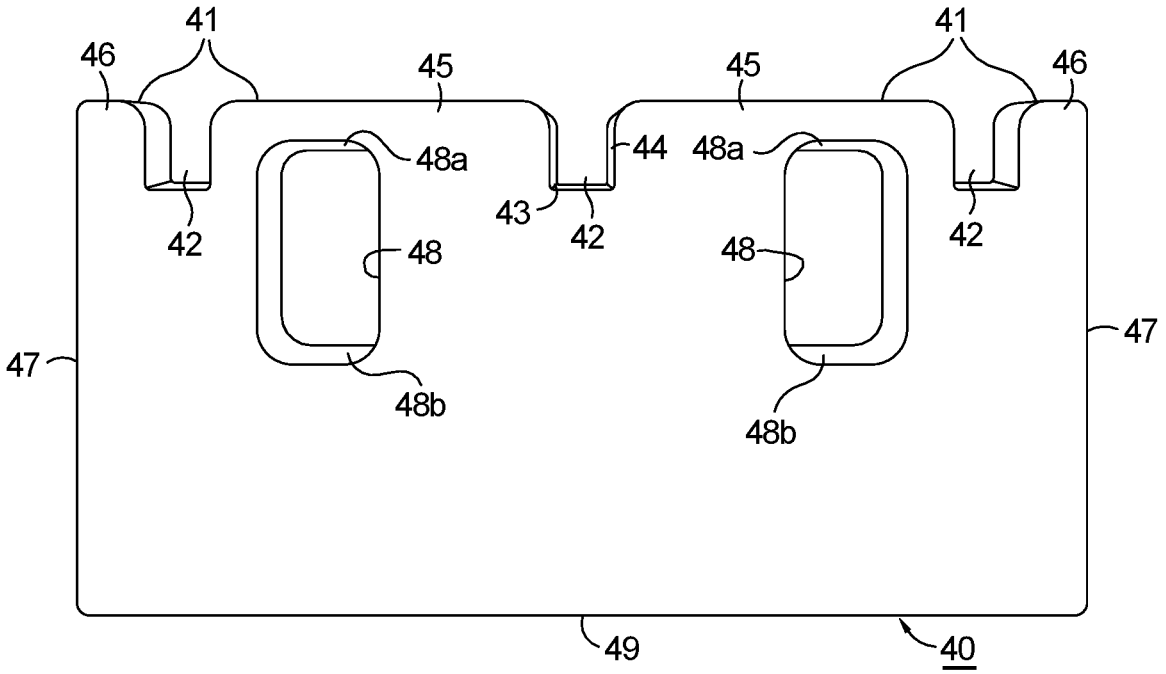
FIGS. 9A and 9B show a front view and a perspective view of the cutting edge of the cutting edge attachment, according to an example embodiment.
Figure 9B:
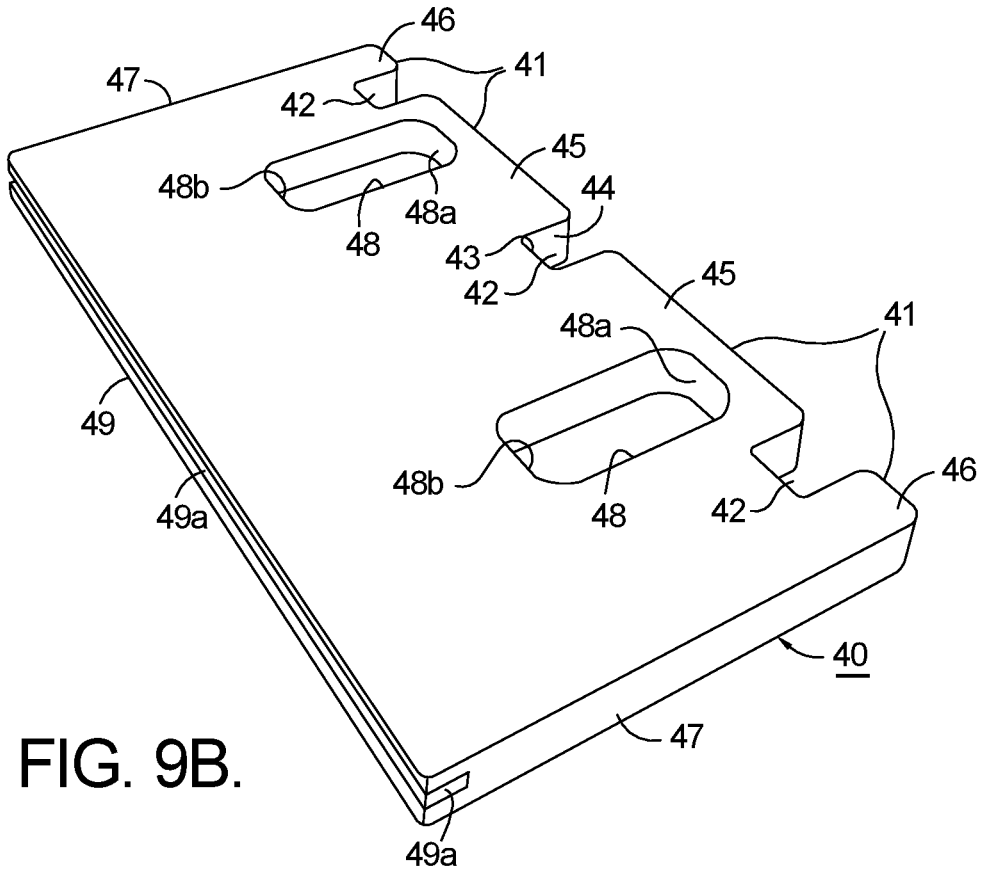

FIGS. 9A and 9B show a front view and a perspective view of the cutting edge 40 of the cutting edge attachment 9, according to an example embodiment. As shown in FIGS. 9A and 9B, cutting edge 40 includes top edge 41, side edges 47, and bottom edge 49. Top edge 41 may include notches 42, wherein each notch 42 includes a bottom 43 and two sides 44 for receiving and supporting springs 30. Notches 42 in top edge 41 may form inner extensions 45 and outer extensions 46. In some example embodiments, cutting edge 40 may have an insert 49*a* (e.g., a carbide insert) affixed to, defined in, or positioned in a channel disposed in, bottom edge 49, as best seen in FIG. 9B. Cutting edge 40 also includes elongated openings 48 including top surface 48*a* and bottom surface 48*b*. During assembly, through-hole bushings 28 of cover retaining plate 20 are inserted through elongated openings 48 of cutting edge 40. During operation, as springs 30 compress in the vertical direction due to an upward force F applied to bottom edge 49 of cutting edge 40, the distance of travel (or retraction) of cutting edge 40 along through-hole bushings 28 may be limited by top surface 48*a* and bottom surface 48*b* of elongated openings 48, according to some example embodiments.

Figure 10A:
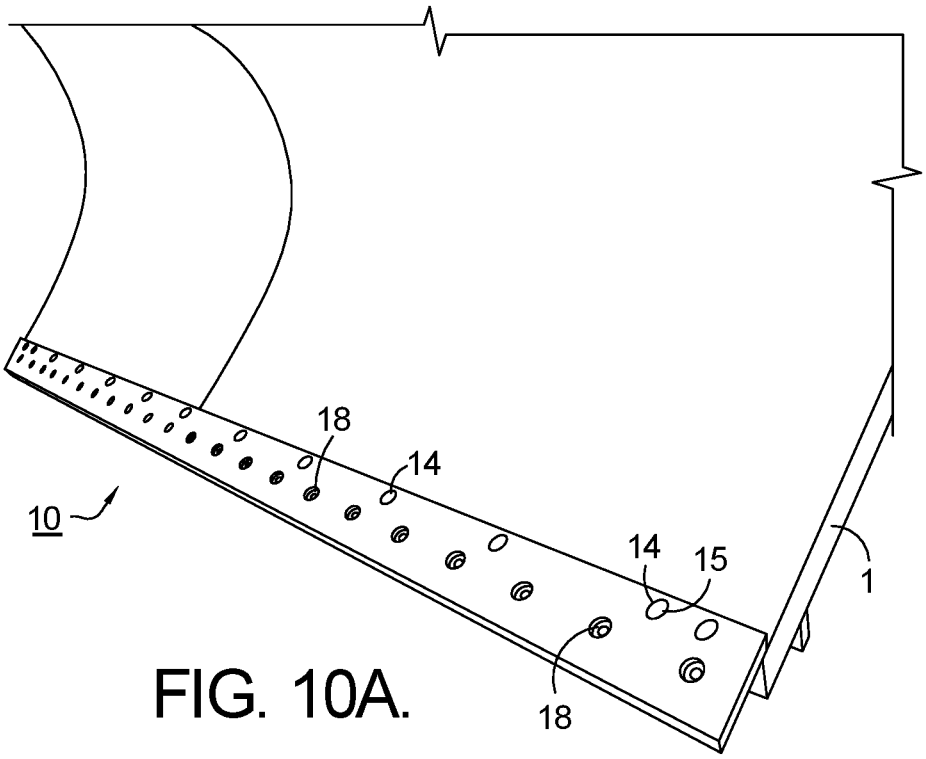
FIGS. 10A and 10B show a front view and a perspective view of the adapter plate of the snow plow cutting edge device, according to an example embodiment.
Figure 10B:
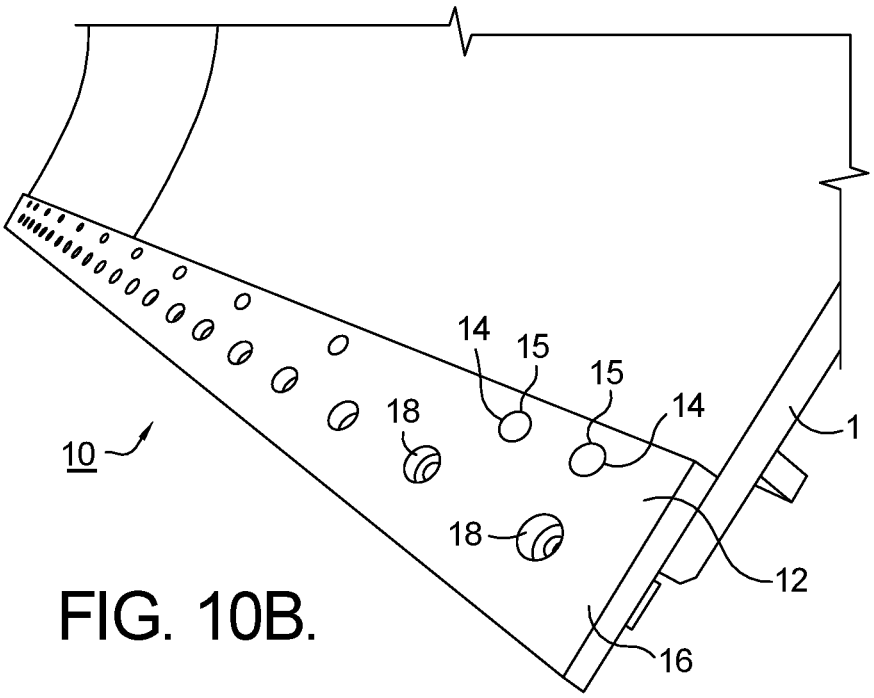

FIGS. 10A and 10B show a front view and a perspective view of the adapter plate of the snow plow cutting edge device, according to an example embodiment. As shown in FIGS. 10A and 10B, adapter plate 10 includes bolt holes 14 for attaching adapter plate 10 to plow moldboard 1, and bolt holes 18 for attaching the cutting edge attachment (including cover retaining plate 20, springs 30, and cutting edge 40) to adapter plate 10. The length of adapter plate 10 and the number of bolt holes 14, 18 shown in the figures is not limiting, and many other configurations are possible depending on the size/width of the snow plow itself, for example.

During assembly, the cutting edge attachments may be mounted onto snow plow moldboard 1 via adapter plate 10 by inserting through-hole bushings 28 of cover retaining plate 20 through bolt holes 18 of adapter plate 10, and securing cover retaining plate 20 to adapter plate 10 by installing bolts 25 in through-hole bushings 28. Each cutting edge attachment may be installed onto and removed from adapter plate 10 individually (independent of other cutting edge attachments). Each cutting edge 40 may operate (move vertically, retract) independently of other cutting edges 40 along the length of the adapter plate 10.

Figure 11:
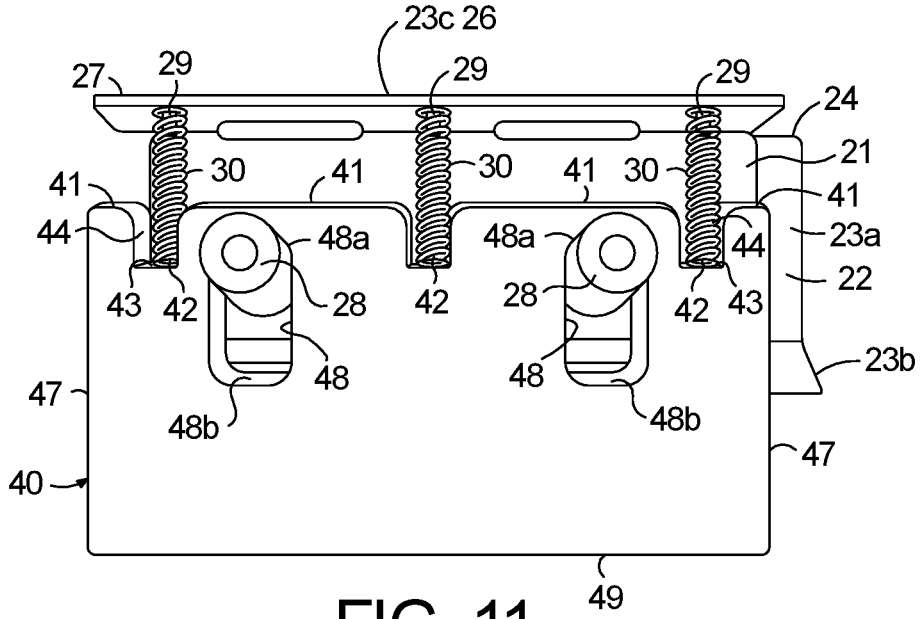
FIG. 11 is a rear view of the back side of an assembled cutting edge attachment, according to an example embodiment.

FIG. 11 is a rear view of the back side of an assembled cutting edge attachment, according to an example embodiment. Similar to FIG. 3 above, FIG. 11 shows an assembled cutting edge attachment including cover retaining plate 20, springs 30, and cutting edge 40, with the springs installed between third portion 26 (top edge extension 23*c*) of cover retaining plate 20 and notches 42 in top edge 41 of cutting edge 40.

During assembly, springs 30 are installed such that the bottom part of springs 30 are inserted into and are surrounded by bottom surface 43 and side surfaces 44 of notches 42, and the top part of the springs 30 are inserted onto and surround support posts 29. As shown in FIG. 11, once springs 30 are installed, the compressive strength of springs 30 will bias through-hole bushings 28 against top surface 48*a* of cutting edge 40. Springs 30 are capable of compressing in the vertical direction, and cutting edge 40 is capable of sliding along through-hole bushings 28 in the vertical direction (or at a tilted angle).

During operation, when an upward force F is applied to bottom edge 49 of cutting edge 40, springs 30 will compress and cutting edge 40 will slide along through-hole bushings 28 in the vertical direction, with maximum retraction being limited by through-hole bushings 28 coming into contact with bottom surface 48*b* of elongated openings 48 of cutting edge 40, according to some example embodiments.

Additionally or alternatively, the maximum retraction of cutting edge 40 could also be limited by the size or strength of springs 30, or by top edge 41 of cutting edge 40 coming into contact with bottom side of third portion 26 (top edge extension 23*c*) of cover retaining plate 20.

Figure 12:
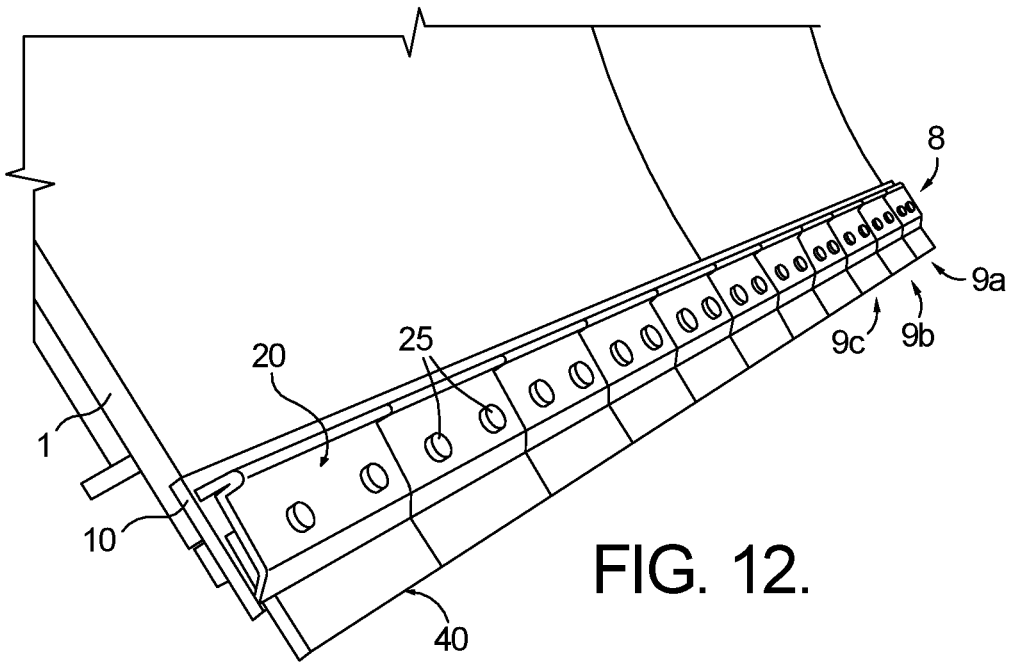
FIG. 12 is another front perspective view of a snow plow cutting edge device including a plurality of cutting edge attachments, according to an example embodiment.

FIG. 12 is another front perspective view of a snow plow cutting edge device 8 including a plurality of cutting edge attachments 9, according to an example embodiment. Similar to FIG. 1 above, FIG. 12 shows a plurality of cutting edge attachments 9 each including cover retaining plate 20, springs 30, and cutting edge 40, which can be individually installed onto or removed from adapter plate 10 that is mounted to moldboard 1 of a snow plow. Each cutting edge 40 of each cutting edge attachment is configured to retract (slidably move in the vertical direction or at a tilted angle relative to the road surface) independently of other cutting edges 40 of the other cutting edge attachments 9 that are mounted to snow plow moldboard 1 via adapter plate 10. Although FIG. 1 shows that top portion 12 of adapter plate 10 can be left exposed after cutting edge attachments 9 are installed, thereby providing access to bolts 15 securing adapter plate 10 to moldboard 1, FIG. 12 shows that the cutting edge attachments 9 may actually cover the top portion 12 and bolts 15 of adapter plate 10 when installed, according to another example embodiment. This modification frees up space to allow springs 30 to have more room while not making the overall snow plow blade system too tall, which provides enhanced flexibility in a tight space as well as increases strength because the cutting edge attachments 9 will have more of adapter plate 10 behind them for increased support during operation.

Once installed, a plurality of cutting edge attachments 9 are aligned in a row across the length of adapter plate 10. Cover retaining plates 20 partially overlap with adjacent cover retaining plates 20, where extension 27 at the end of third portion 26 (or top edge extension 23*c*) of one cover retaining plate 20 meets extension 24 at the opposite end of second portion 22 (middle section 23*a* and bottom section 23*b*) of another cover retaining plate 20 that is adjacent thereto.

Cutting edges 40 are supported between adapter plate 10 on one side (the back side) and cover retaining plate 20 on the other side (front side). Thus, horizontal movement of cutting edge 40 is limited by adapter plate 10 and cover retaining plate 20. On the other hand, vertical movement of cutting edge 40 is limited by the compressive strength of springs 30, and the positional relationship between through-hole bushings 28 and top surface 48*a* and bottom surface 48*b* of elongated openings 48 of cutting edge 40.

During operation of the snow plow cutting edge device 8, each cutting edge 40 of each of the plurality of cutting edge attachments 9 can retract at different times and to different degrees in order to adapt to varying forces F that are caused by non-level road surfaces and road obstacles, for example. In addition to being a compact design with relatively few components and moving parts, the specific design of cover retaining plate 20 and cutting edge 30 and their interactions with each other and the springs 30 is particularly unique compared to existing snow plow designs with a flexing feature or retracting capability.

As described above with reference to FIGS. 1-12, the snow plow cutting edge device 8 and cutting edge attachments 9 enable improved engagement with uneven road surfaces and adaptation to obstacles in the road, which results in more effective removal of snow and ice from road surfaces. Example embodiments described herein also reduce the maintenance times and costs of repair or replacement in the event of worn or damaged cutting edges or other components, and have a modular configuration allowing for easy installation and removal, which can improve operator satisfaction with the overall performance of the snow plow cutting edge device. The cover retaining plate and the cutting edge of the cutting edge attachments also have unique designs, configurations, shapes, and/or arrangements compared to existing snow plow cutting edge devices, regardless of whether their corresponding cutting edge is fixed or includes multiple flexible or retractable elements.

Figure 14A:
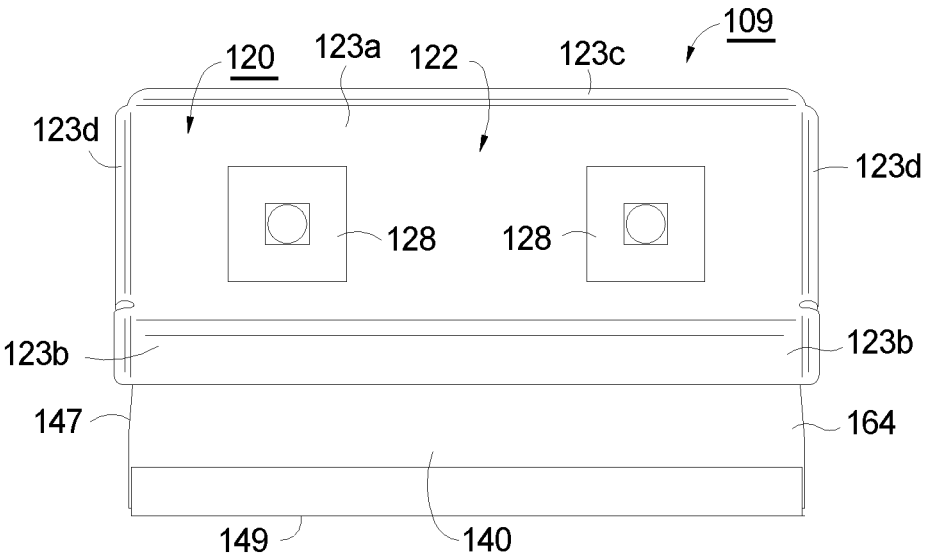
FIGS. 14A and 14B show a front view and a back view of the snow plow blade attachment shown in FIG. 13, respectively.
Figure 14B:
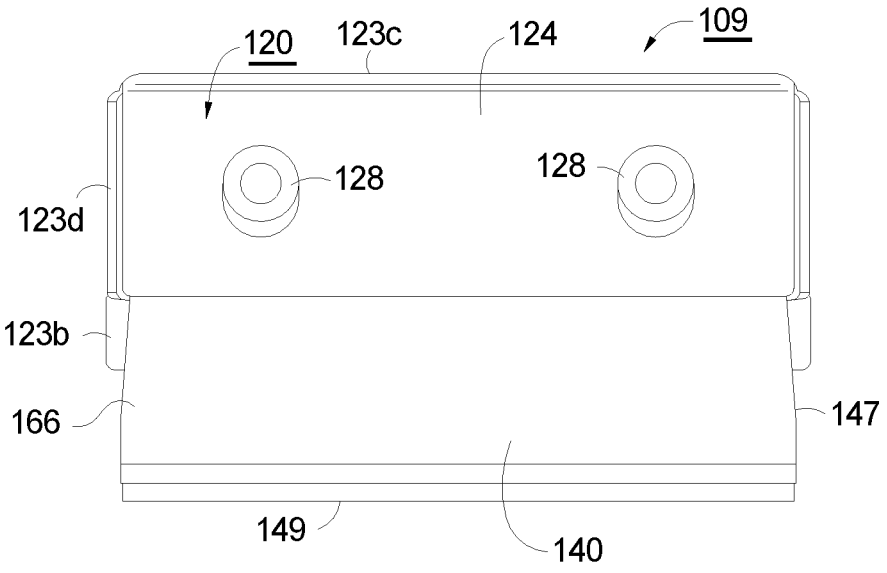
Figure 15:
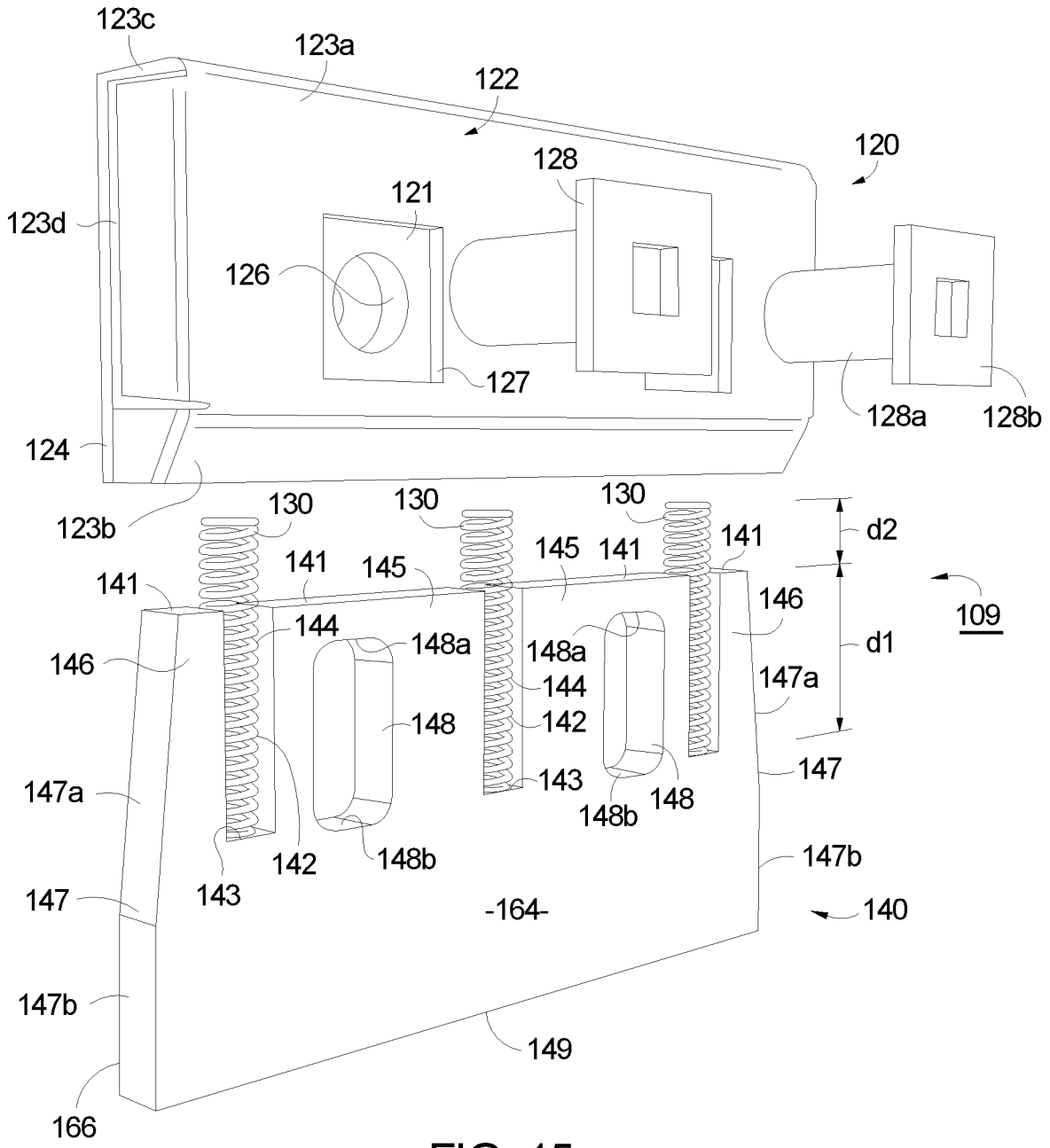
FIG. 15 shows an exploded view of the snow plow blade attachment of FIG. 13 including a blade retainer, springs, and a blade.
Figure 16:
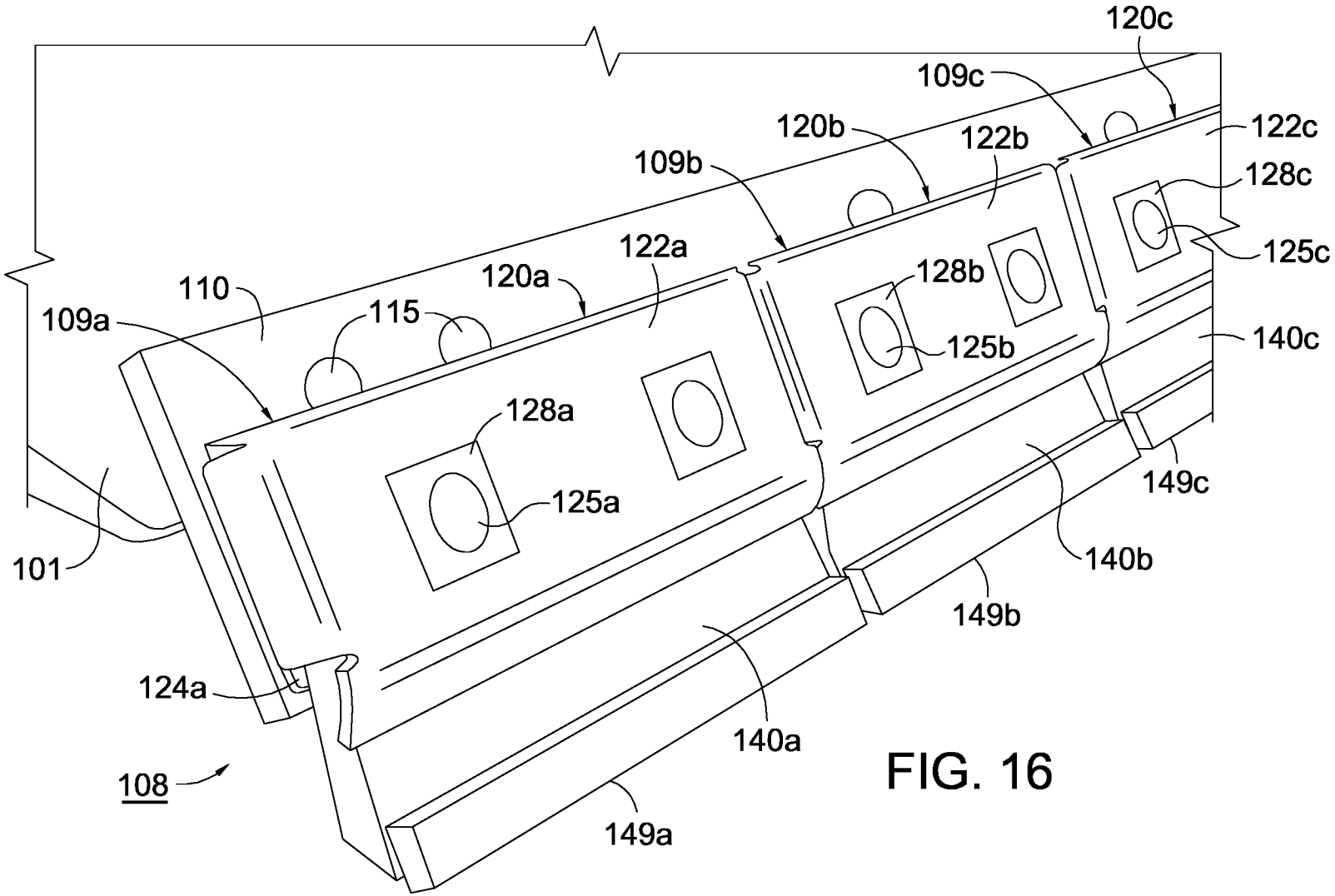
FIG. 16 shows a perspective view of a snow plow cutting edge device including a plurality of blade attachments of FIG. 13.

Turning now to FIGS. 13-16, another exemplary embodiment of a snow plow cutting edge device 108 including a plurality of blade attachments 109*a*, 109*b*, 109*c* is provided. As shown in FIG. 16, snow plow cutting edge device 108 includes an adapter plate 110 and a plurality of blade attachments 109*a*, 109*b*, 109*c*. As shown in FIGS. 13, 14A-14B, and 15, each blade attachment 109*a*, 109*b*, 109*c* is a self-contained assembled unit that includes a blade retainer 120, a plurality of springs 130, and a blade 140.

In an exemplary embodiment, adapter plate 110 may be a single elongated plate. An upper portion of adapter plate 110 has bolt holes defined therein that are designed to align with corresponding bolt holes of a moldboard 101 of a snow plow configured for mounting on the front of a truck or other vehicle. The design and mechanisms for attachment of moldboard 101 to the front end of the truck or other vehicle may be various standard attachment mechanisms known in the industry. For example, bolts 115 may be inserted through the respective bolt holes in the upper portion of the adapter plate 110 and moldboard 101 to mount adapter plate 110 to plow moldboard 101. A lower portion of adapter plate 110 has additional bolt holes defined therein that are designed to align with, or accept, bushings 128 of blade retainer 120, which are inserted through elongated openings 148 of blade 140 within blade retainer 120. During assembly, the various bolts may be secured via nuts, washers, and other commonly used fastening mechanims. Bolts may be the same sizes or different widths and/or lengths, as needed or desired for structural support, stability, and durability.

The length of adapter plate 110 may be designed to correspond to various standard sizes of snow plows, extending the entire length (or most) of moldboard 101 of the snow plow. In other exemplary embodiments, adapter plate 110 may comprise multiple plates in a row, so as to provide a modular design of varying lengths. Also refer to FIG. 17B regarding adapter plate 110.

For each blade attachment 109 of snow plow cutting edge device 108, blade retainer 120 attaches or otherwise retains blade 140 to adapter plate 110. The springs 130 allow each blade 140 to slidably move generally perpendicularly to the road surface (or on a slight tilt/angle relative to the road surface) during operation to adjust to varying road conditions independently of other blades 140 of the other blade attachments 109 mounted to adapter plate 110. Additional details of blade retainer 120, springs 130, and blade 140 will be described below with reference to FIG. 15.

FIG. 15 is an exploded view showing the components of a single blade attachment, according to an exemplary embodiment. As shown in FIG. 15 and mentioned above, each blade attachment 109 includes blade retainer 120, a plurality of springs 130, and blade 140. Each of these elements, along with their arrangements and interactions with respect to each other, will be further described in detail below.

Blade retainer 120 secures or otherwise retains blade 140 to adapter plate 110, wherein blade 140 is movably disposed within blade retainer 120. Blade retainer 120 also holds springs 130 in place once assembled, and during operation of snow plow cutting edge device 108. The blade retainer 120 includes a front plate 122, a back plate 124, and a pair of bushings 128.

The front plate 122 includes a middle portion 123*a*, a bottom portion 123*b*, a top portion 123*c*, and side portions 123*d*. The front plate 122 may also include a spacer plate 121 (FIG. 15), which may be a flat recessed plate that is welded or otherwise fixedly attached to the back surface of middle portion 123*a* of front plate 122. The spacer plate 121 includes holes 126 through which the pair of bushings 128 protrude outward from the back surface of blade retainer 120, wherein bushings 128 can receive bolts 125 during assembly of the snow plow cutting edge device 108.

The middle portion 123*a* of front plate 122 may be a flat rectangular middle section with holes 127 through which bushings 128 can be inserted to protrude outward from the back surface of blade retainer 120. The bottom portion 123*b* of front plate 122 is an angled bottom section. The angle at which bottom portion 123*b* is bent to form flat middle portion 123*a* and bottom portion 123*b* may be diagonal (about 45 degrees, although this is non-limiting and the angle may be greater or less than 45 degrees). The bottom portion 123*b* could also be curved in some other example embodiments (a more rounded bend instead of bent at a relatively straight angle). Bottom portion 123*b* includes a distal edge that is positioned adjacent to or in sliding contact with, blade 140. The distal edge of bottom portion 123*b* of front plate 122 may operate to guide or otherwise maintain the path of travel of blade 140 as it moves linearly between front plate 122 and back plate 124 of blade retainer 120.

The top portion 123*c* of front plate 122 may be arranged perpendicular to middle portion 123*a* (and spacer plate 121) of front plate 122. The side portions 123*d* of front plate 122 extend from the side of front plate 122 and wrap around the side edge of blade 140.

Figure 13:
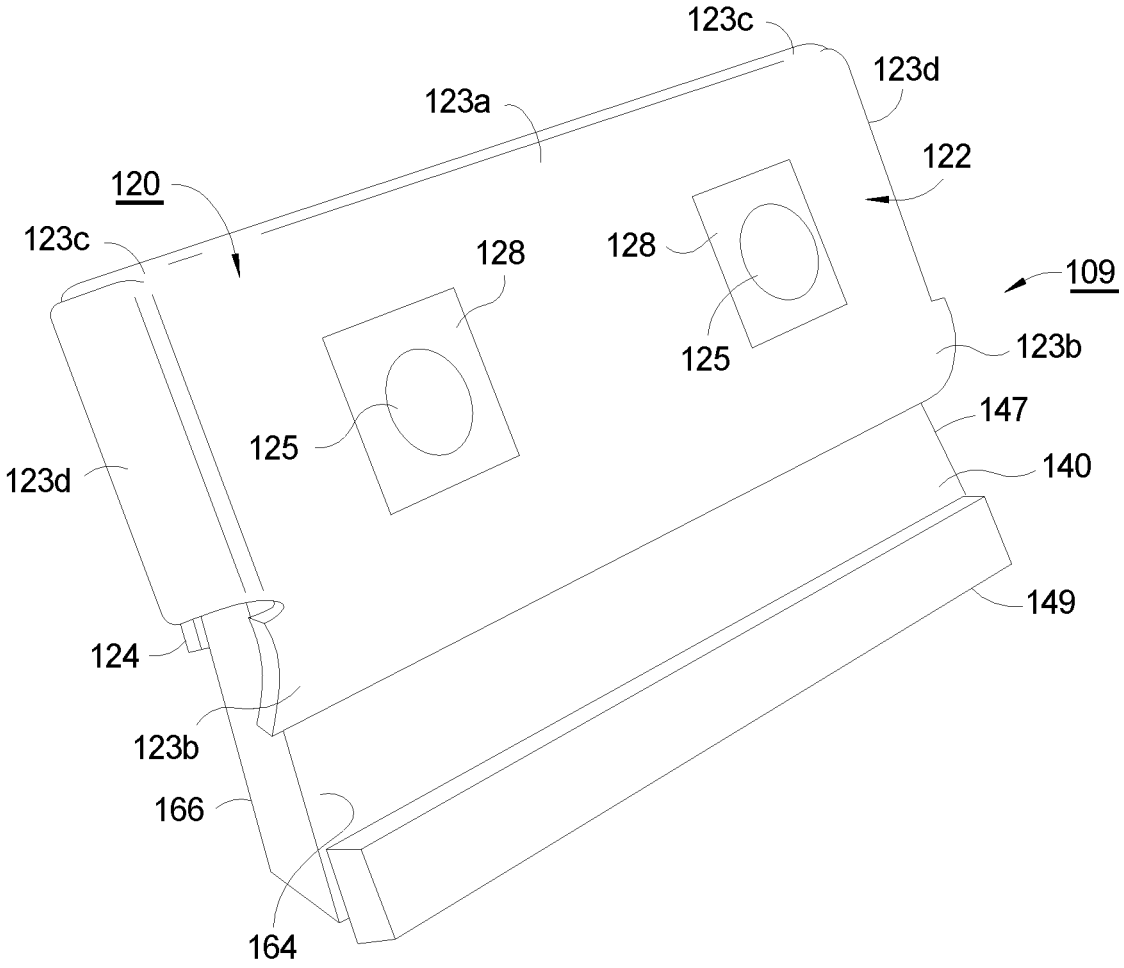
FIG. 13 shows a front perspective view of a snow plow blade attachment according to an exemplary embodiment.

Top portion 123*c* and side portions 123*d* may be integrated together with middle portion 123*a* of front plate 122 as a single component of blade retainer 120. For example, middle portion 123*a*, bottom portion 123*b*, top portion 123*c*, and side portions 123*d* may be formed by cutting a single metal plate at its upper corners and sides (and optionally cutting out small notches so that the front plate 122 can have the desired dimensions and shape as generally shown in FIGS. 13, 15, and 16), and then bending the single metal plate at lower, upper, and side portions to the appropriate or desired angles for bottom portion 123*b*, top portion 123*c*, and side portions 123*d*, respectively. In some example embodiments, the vertical distance between the lower and upper bends (the bend between bottom portion 123*b* and flat middle portion 123*a*, and the bend between top portion 123*c* and flat middle portion 123*a*) corresponds to the vertical width of spacer plate 121, and the horizontal distance between the side bends (the bends between side portions 123*d* and flat middle portion 123*a*) corresponds to the horizontal length of spacer plate 121. Thus, spacer plate 121 may lay flat against middle portion 123*a*, and bottom portion 123*b*, top portion 123*c*, and side portions 123*d* may wrap around spacer plate 121, at a diagonal angle (or curve) for bottom portion 123*b* and at right angles for top portion 123*c* and side portions 123*d*, respectively. Spacer plate 121 may be welded to middle portion 123*a* at or near the lower and upper bends (and/or at or near the side bends).

However, in an alternative embodiment, top portion 123*c* and/or side portions 123*d* may each be separate and distinct metal plates that are welded to the top and sides of middle portion 123*a* (and/or spacer plate 121), respectively, at a right angle (about 90 degrees) so as to be attached perpendicular thereto and form the structure of front plate 122. In both of these example embodiments, back plate 124 may then be welded to top portion 123*c* and side portions 123*d* of front plate 122 to form blade retainer 120. It should also be understood that bending and welding are non-limiting example embodiments, and various other known suitable attachment mechanisms for the components of blade retainer 120 are also possible.

Thus, with the unique structure of front plate 122 (and its elements 121, 123*a*, 123*b*, 123*c*, and 123*d*) combined together with back plate 122, blade retainer 120 forms a housing that can totally or substantially encase blade 140 therein on all sides (except for the bottom edge thereof). In addition, bushings 128 are removable so that blade 140 can slide into blade retainer 120 and then be locked into place when bushings 128 are inserted through elongated openings 148 defined in blade 140. The encased design for blade retainer 120 for enclosing a relatively short (e.g., twelve inches or about one foot) section of a snow plow blade on all sides (upper, sides, front, and back) except for the bottom cutting edge of the blades is shown in FIGS. 13, 14A-14B, 15, and 16.

In some example embodiments, top portion 123*c* also includes a plurality of support posts 129 (not shown in FIGS. 13-16) extending down from a bottom surface thereof that are designed to receive and maintain the position of springs 130 within blade retainer 120. In particular, a top part of springs 130 slides over and around, and engages with, support posts 129, respectively. Support posts 129 are configured to secure springs 130 during assembly of the snow plow blade attachments 109 and prevent lateral movement of springs 130 during operation of the snow plow cutting edge device 108.

Springs 130 allow blade 140 of each blade attachment 109 to move up and down along with the road surface during operation of the snow plow cutting edge device 108. Springs 130 may be die springs or other similar CNC-machined compression springs, for example. Springs 130 may be formed using various kinds of metals as commonly known in the industry, and may have a cylindrical, squared, or rectangular shape, for example, with at least one open end (the top end corresponding to support posts 129). However, example embodiments are not limited thereto, and various other types of compression springs or other flexible spring-like mechanisms may be utilized. Alternatively, springs 130 may be made of flexible polymer or elastomer materials, for example. Springs 130 may have coils, or may be solid or molded, or may be rubberized hollow cylindrical or tube-like structures. Each spring 130 may be identical, but this is not required and some springs may have different lengths, widths, compressive strengths, shapes, or the like as compared to each other, to allow for varying degrees and forces required for retraction of blade 140 during operation of the snow plow cutting edge device according to different design needs or desires. Also, springs 130 may be linear or constant rate springs, progressive or variable rate springs, dual or fast/soft rate springs, etc. Springs 130 may be standard off-the-shelf springs widely available and commonly used in the industry, or custom-designed components for different applications.

Although three springs 130 are shown in FIG. 15, some other example embodiments are not limited thereto, and there may be a greater or lesser number of springs per blade attachment. For example, there may be only two outer springs or a single inner spring, or there may be a pair in inner springs and a pair of outer springs. In the case of fewer than three springs the springs may be larger and/or may have more resistance, and in the case of more than three springs the springs may be smaller and/or may have less resistance. Example embodiments are not limited to the arrangements and dimensions of the springs as shown in the figures.

As mentioned above, the top part (open top end) of spring 130 slides over and around, and engages with, respective support posts 129 extending downward from the bottom surface of top section 123*c* of blade retainer 120. In addition, the bottom part (open bottom end) of spring 130 slides into, and engages with, a respective notch 142 defined in top edge 141 of blade 140, as discussed in further detail below.

Blade 140 is configured to engage with the road surface during operation of the snow plow cutting edge device 108. Blade 140 includes a front surface 164, a back surface 166, a top edge 141 including notches 142 formed therein, a pair of side edges 147, a pair of elongated openings 148 defined therein extending between front surface 164 and back surface 166, and a bottom edge 149. Blade 140 may be a relatively short segment of an entire cutting edge device 108 for a snow plow, such as a twelve inch segment for example. Blade retainer 120 may similarly be a short segment (e.g., about twelve inches) of the entire cutting edge device 108, where each blade attachment 109 includes one blade retainer 120 per one blade 140. Thus, each blade attachment 109 is roughly one foot in length, in a non-limiting illustrative example. However, example embodiments are not limited thereto, and each blade 140 and/or blade retainer 120 may be somewhat shorter or longer in the horizontal direction along the snow plow edge in modified designs. Similarly, example embodiments are not limited to the width of blade 140 and/or blade retainer 120 in the vertical direction as shown in the figures.

Top edge 141 of blade 140 may be partially flat (or straight) in the horizontal direction, except for notches 142 formed in top edge 141 of blade 140. Notches 142 may be a square or rectangular shape formed by cutting out small sections spaced along top edge 141. Notches 142 may thus include a flat bottom surface 143 and two flat side surfaces 144 that are designed to receive and support springs 130. The bottom part of spring 130 slides into notch 142 and engages with bottom surface 143 of notch 142 to secure spring 130 during assembly of blade attachments 109, while side surfaces 144 of notch 142 prevent lateral movement of spring 130 during operation of the snow plow cutting edge device 108.

Although three notches 142 are shown in the figures, some other example embodiments are not limited thereto, and there may be a greater or lesser number of notches per blade. For example, there may be only two outer notches or a single inner notch, or there may be a pair of inner notches and a pair of outer notches. In the case of fewer than three notches the notches may be wider to accommodate larger springs, and in the case of more than three notches the notches may be narrower to accommodate smaller springs. Example embodiments are not limited to the arrangements and dimensions of the notches as shown in the figures.

Notches 142 in top edge 141 may form inner extensions 145 and outer extensions 146, where inner extensions 145 may be wider/larger and the outer extensions 146 are narrower/smaller compared to each other. Top edge 141 of inner extensions 145 and top edge 141 of outer extensions 146 may lie along the same plane (they are flush or aligned with each other). Likewise, bottom surface 143 of inner notch 142 and the bottom surfaces 143 of outer notches 142 may lie along the same plane (they are flush or aligned with each other). However, other arrangements and dimensions of inner extensions and outer extensions are also possible (e.g., in the alternative embodiments where there are only one or two springs/notches, or where there are four or more springs/notches).

Side edges 147 of blade 140 may be flat (or straight) in the vertical direction in some example embodiments. However, in some other example embodiments, as best seen in FIGS. 14A-14B, side edges 147 may slope slightly inward at a slant from bottom to top in order to reduce or limit friction between blades when one blade retracts more than an adjacent blade, or the adjacent blade does not retract, to adapt to an uneven road surface or other obstacle. In yet some other example embodiments, as best seen in FIG. 15, each side edge 147 of blade 140 may have an upper portion 147*a* (upper side edge) that is slanted at an inward angle and a lower portion 147*b* (lower side edge) that is relatively flat/straight in the vertical direction. This inward sloping blade side edge feature could also permit a slight diagonal rotation allowing different degrees or distances of retraction for each end of the same blade 140 (one side of the blade is able to move up or down slightly more than the opposite side of the blade with this design). Respective blades 140 of adjacent snow plow blade attachments 109 may come into contact with each other once assembled and/or during operation, or there may be a slight gap therebetween to avoid or alleviate friction during movement or retraction of the blade. Also refer to FIG. 16 for an example configuration of side edges 147 (147*a*, 147*b*) of adjacent blades 140 with respect to each other. Thus, each individual cutting edge 149 can retract not only along a straight plane but also enables tilted retraction at different angles on a per-blade basis, since the slanted upper side edge 147*a* of one blade 140 is not limited by contact with a side edge of another blade of an adjacent blade attachment. These features allow a snow plow utilizing the blade attachments 109 described herein to better adapt to varying road surfaces and grades including sloped or curved surfaces, and thereby provide enhanced scraping and clearing functionality.

Notches 142 form channels or grooves within the body of blade 140 that have an appropriate depth and width for receiving and supporting springs 130, and limiting lateral movement of the springs 130. A lower portion of spring 130 (indicated with "d1" in FIG. 15) is contained within the body of blade 140 and an upper portion of spring 130 (indicated with "d2" in FIG. 15) extends upward beyond the top edge 141 of blade 140. In some example embodiments, lower portion (d1) of spring 130 has a length that is greater than a length of upper portion (d2) of spring 130, and both springs 130 and notches 142 having a similar width to accommodate springs 130 with a tight fit in notches 142. The specific dimensions may be defined so as to provide improved stability for the springs 130 during operation of the snow plow. In addition to assisting with assembly and installation, the depth and width of the notches 142 providing a tight fit relative to the length and width of the springs 130 could also potentially eliminate the need for support posts 129 to be included on the bottom surface of the top portion 123*c* of front plate 122, according to some example embodiments.

The pair of elongated openings 148 defined in blade 140 are configured to receive the pair of bushings 128 of blade retainer 120, which are inserted through elongated openings 148 when assembled, in order to allow blade 140 to slidably move up and down (either vertically or on a tilted angle relative to the road surface) guided by bushings 128 when an upward force F is applied to bottom edge 149 of blade 140 during operation. Elongated openings 148 define the vertical travel of blade 140. Elongated openings 148 may have a vertical oval or rectangular shape (with or without rounded corners), as shown in FIG. 15.

In some example embodiments, downward movement of blade 140 is limited when top surface 148*a* of elongated opening 148 contacts bushing 128 when spring 130 is decompressed, and upward movement of blade 140 is limited when bottom surface 148*b* of elongated opening 148 contacts bushing 128 during compression of spring 130 when an uneven road surface or other obstacle is encountered.

Further, downward and/or upward movement may be limited by the height and/or the compressive strength of springs 130 and/or the distance of travel between top portion 123*c* of blade retainer 120 and top edge 141 of blade 140. For example, bushings 128 may or may not actually come into contact with bottom surface 148*b* of blade 140 when an upward force F is applied to bottom edge 149 of blade 140 so as to cause maximum retraction of blade attachment 109. Likewise, top edge 141 of blade 140 may or may not actually come into contact with the bottom surface of top portion 123*c* of blade retainer 120 when an upward force F is applied to bottom edge 149 of blade 140 so as to cause maximum retraction of blade attachment 109.

In some example embodiments, elongated openings 148 at least partially overlap with notches 142 in the vertical direction, as shown in FIG. 15. This is to ensure a more compact design compared to other existing flexible snow plow cutting edge devices. However, elongated openings 148 may overlap with notches 142 to a different or modified degree in some other example designs than shown in FIG. 15, to accommodate different sizes of springs 130 and notches 142 and/or different widths of blades 140.

Figure 18A:
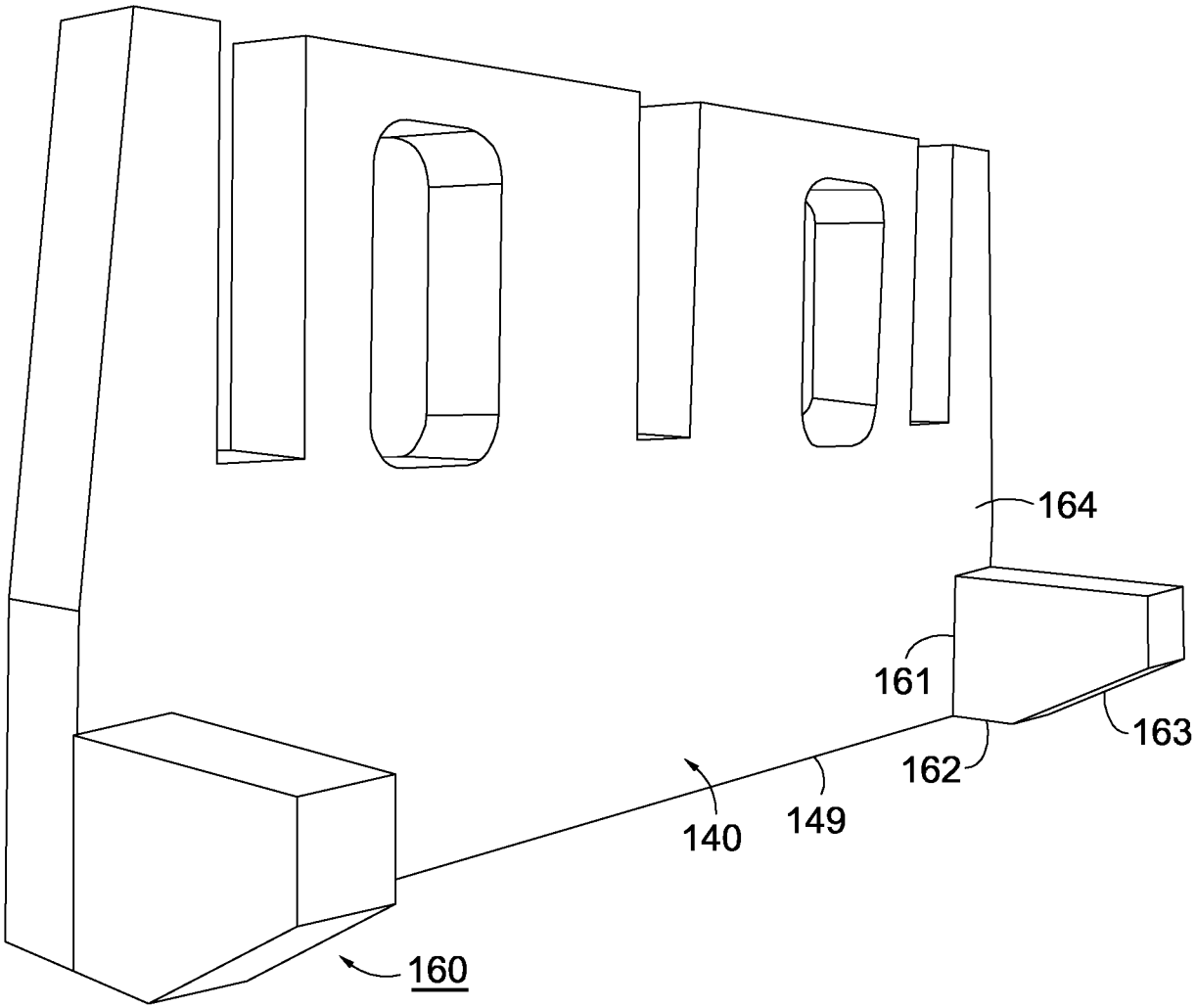
FIGS. 18A and 18B show a perspective view and a front view of a snow plow blade modified to include a pair of wing tips according to yet another exemplary embodiment, respectively.
Figure 18B:
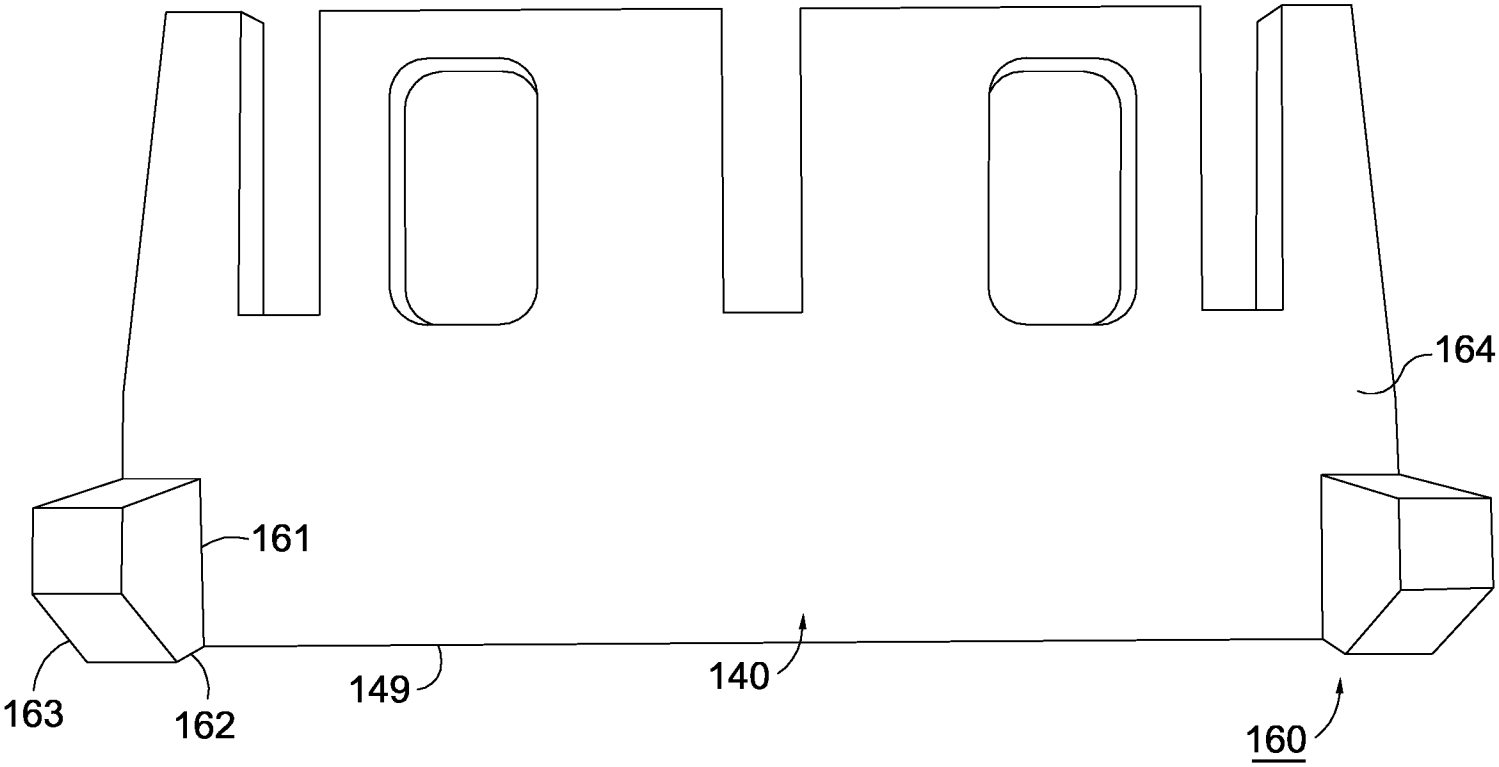

Bottom edge 149 of blade 140 may be flat (or straight) and is the portion of blade attachment 109 that actually scrapes the snow and/or ice that has accumulated on the road surface during operation of snow plow cutting edge device 108. Thus, blade 140, and particularly bottom edge 149 thereof, is the component that is most susceptible to wear and damage over time, due to the various uneven road surfaces and other obstacles that the snow plow may encounter during normal operation. As shown in FIGS. 13, 14A-14B and 16, bottom edge 149 of blade 140 may comprise an extra layer of plating that is fixedly attached (e.g., welded) to front surface 164 of blade 140 along the length of bottom edge 149 in some example embodiments. However, this extra strip of plating is considered optional and may not be included in some other example embodiments of blade 140, as shown in FIGS. 15 and 18A-18B, for example.

To address this issue of wear and tear of blade 140 (and bottom edge 149 in particular), the design and configuration of blade attachment 109 (including blade retainer 120, springs 130, and blade 140) allows for quick and easy installation and removal as well as low cost repair and/or replacement of individual blades 140, as the need arises. Further, springs 130 have a simple design and are individually replaceable if needed, and do not require a customized retraction mechanism such as flexible elastomeric members with non-standard shapes and/or different widths at different portions and/or different compressive strengths along the length thereof. Therefore, blade attachments 109 according to example embodiments described herein provide numerous improvements over fixed cutting edges, non-modular designs, and complicated or custom-designed flexible mechanisms or components that may permit retraction of cutting edges in some form.

Also, blade attachments 109 of snow plow cutting edge device 108 according to example embodiments described herein provide a further advantage over existing snow plow cutting edge devices in that the respective springs 130 of each blade attachment 109 can compress and expand independently of springs of other blade attachments of snow plow cutting edge device 108, such that each blade 140 can adapt independently to varying road conditions along the length of snow plow moldboard 101 and adapter plate 110 as the snow plow encounters uneven road surfaces and other obstacles during normal operation.

Furthermore, the design of snow plow cutting edge device 108 allows each individual blade attachment 109 to be removed and repaired or replaced if needed, as parts become worn or damaged. Similarly, each individual blade retainer 120 and/or each individual blade 140 may be easily removed and replaced as needed (e.g., in twelve inch or about one foot sections), without requiring any disassembly or replacement of the other blade attachments and blades of the snow plow cutting edge device (e.g., loosening or removing bolts of neighboring blade sections to pry out one section is not needed). Thus, the modular design of blade attachments 109 allows individual sections to easily and quickly be changed out without disturbing adjacent sections of snow plow cutting edge device 108 while at the same time keeping all of the components in the blade attachment together as a single unit that can be installed, removed and replaced.

In a default state or position of blade attachment 109 once assembled, when no upward force F is being applied to bottom edge 149 of blade 140, springs 130 are in a decompressed state and bushings 128 of blade retainer 120 are in contact with or adjacent to top surface 148*a* of elongated openings 148 of blade 140. As blade attachments 109 encounter uneven road surfaces or other obstacles during normal operation of snow plow cutting edge device 108, blade 140 may move up and down relative to blade retainer 120 dictated by the outer limits of openings 148 in blade 140. For example, springs 130 may transition to a compressed state and bushings 128 of blade retainer 120 may come into contact with bottom surface 148*b* of elongated openings 148 of blade 140. This may be considered the maximum retraction state or position of blade attachment 109, when an upward force F is being applied to bottom edge 149 of blade 140.

FIG. 16 illustrates the modular design of the blade attachment when installed with a plurality of other blade attachments to form the snow plow cutting edge device according to exemplary embodiments described herein. A pair of adjacent blade attachments 109 may partially contact each other (e.g., at their side portions 123*d* of front plates 122 of blade retainers 120, respectively) when they are aligned and mounted to adapter plate 110 by inserting bushings 128 through holes 115 during installation along the length of adapter plate 110 and moldboard 101 of the snow plow.

Any individual blade attachment 109 can be installed on and removed from adapter plate 110 independently of the other blade attachments of snow plow cutting edge device 108. Any individual blade 140 can also retract independently of the other blades of the other blade attachments of snow plow cutting edge device 108, which is caused by an upward force F being exerted on bottom edge 149 of blade 140 (e.g., resulting from an uneven road surface or other obstacle in the road during normal operation).

When a blade 140 of one of the blade attachments 109 retracts during operation, springs 130 within that blade attachment 109 are compressed, and the position of top edge 141 and bottom edge 149 of that blade 140 of that blade attachment 109 move upward in the vertical direction, relative to the respective components of the adjacent blade attachments. Movement of blades 140 in the vertical direction may be controlled or limited when bushings 128 of blade retainers 120 come into contact with bottom surface 148*b* and/or top surface 148*a* of the elongated openings 148 of blades 140 as different forces are encountered on road surfaces during operation, for example.

Thus, each blade 140 of each individual blade attachment 109 is slidably movable, along bushings 128 within elongated openings 148, to and from the retracted state or position, independently of other blades of neighboring blade attachments. Similarly, each set of springs 130 of each individual blade attachment 109 are compressible independently of other sets of springs of neighboring blade attachments. These features help the snow plow cutting edge device to be able to better adapt to varying road conditions with its modular cutting edge attachment design.

Furthermore, each blade 140 and/or other components of each blade attachment 109 are installable/removable and repairable/replaceable independently of other blades 140 and/or components of other blade attachments 109. This helps to reduce maintenance time and lower costs, and thereby increase overall operator satisfaction with the improved snow plow cutting edge device 108.

As described above with reference to FIGS. 13, 14A-14B, 15 and 16, snow plow cutting edge device 108 and blade attachments 109 enable improved engagement with uneven road surfaces and adaptation to obstacles in the road, which results in more effective removal of snow and ice from road surfaces. Example embodiments described herein also reduce the maintenance times and costs of repair or replacement in the event of worn or damaged cutting edges or other components, and have a modular configuration allowing for easy installation and removal, which can improve operator satisfaction with the overall performance of snow plow cutting edge device 108. The blade retainers and the blades of the blade attachments also have unique designs, configurations, shapes, and/or arrangements compared to existing snow plow cutting edge devices, regardless of whether their corresponding cutting edge is fixed or includes multiple flexible or retractable elements.

Next, additional exemplary embodiments of the present invention will be described with reference to FIGS. 17A-17B and FIGS. 18A-18C, respectively.

In addition to the above-described needs and solutions of FIGS. 13-16, there is also a need for an improved corner piece for the end of the snow plow. For example, existing snow plow nose pieces are typically immovable and bolted to the plow. However, this may not be ideal for a snow plow design with retractable blades.

Figure 17A:
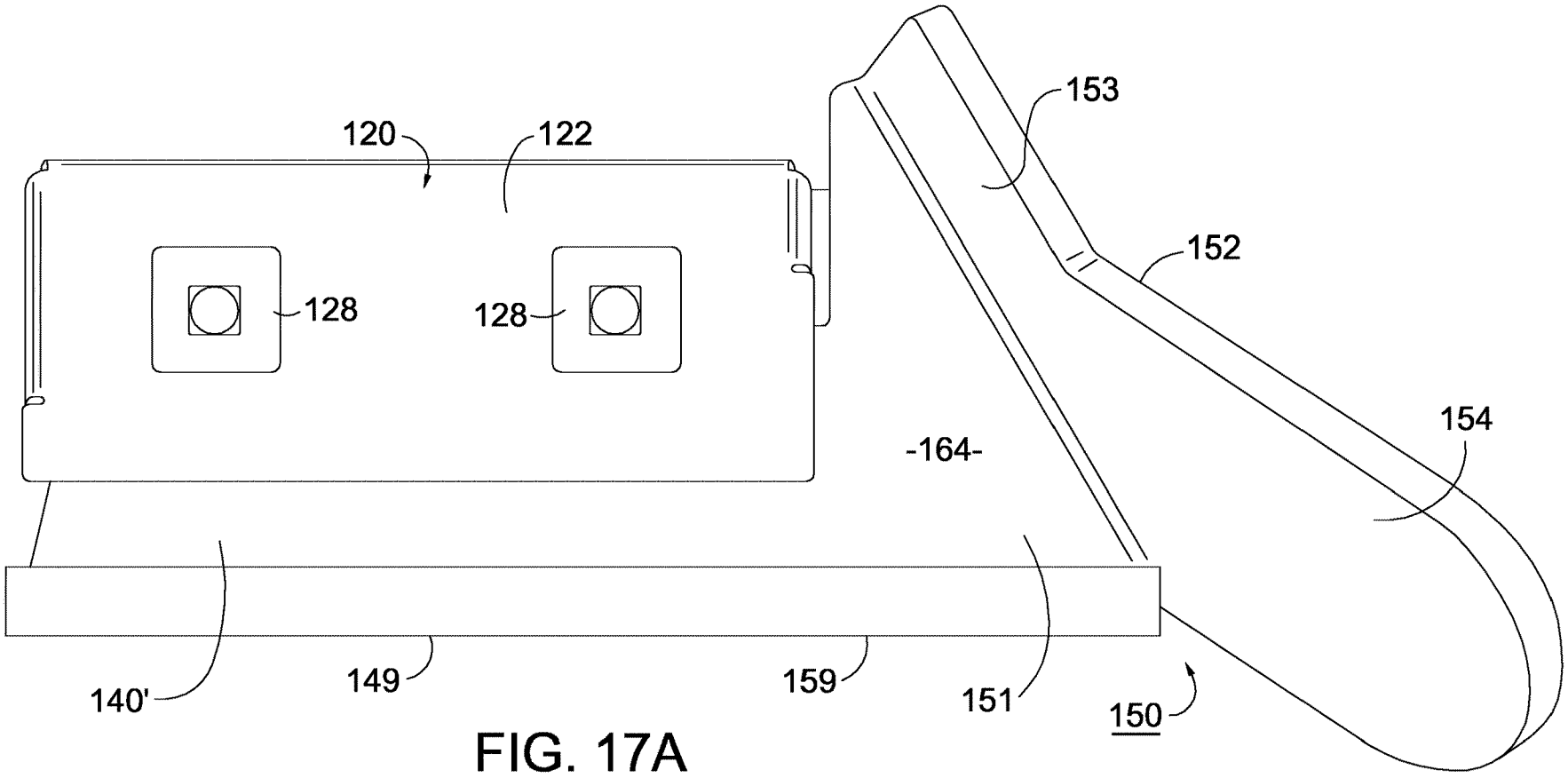
FIG. 17A shows a front view of an end snow plow blade attachment with the blade modified to include a nose piece according to another exemplary embodiment.

Therefore, according to another example embodiment shown in FIG. 17A, a blade 140' can be modified to include a nose piece 150. The nose piece 150 may be welded or otherwise fixedly attached to one side edge 147 of a blade to form blade 140'. In some example embodiments, nose piece 150 includes a side extension 151 and an end plate 152 that extends at an angle (at a right angle or an outward sloping diagonal angle, as shown in FIG. 17A) relative to side extension 151. Side extension 151 may be configured as a continuous extension from blade 140 (FIG. 13) that is disposed outside the confines of side portion 123*d*. End plate 152 may include a top portion 153 and a bottom lobe portion 154 that extends forward from front surface 164 of side extension 151 to provide containment of snow being displaced by blade 140'. Side extension 151 also includes a bottom edge 159, which is an extension of bottom edge 149 of blade 140' along the length of the bottom of side extension 151. Bottom portion 154 may also include a bottom edge 161 that is a continuation of bottom edge 159.

Figure 17B:
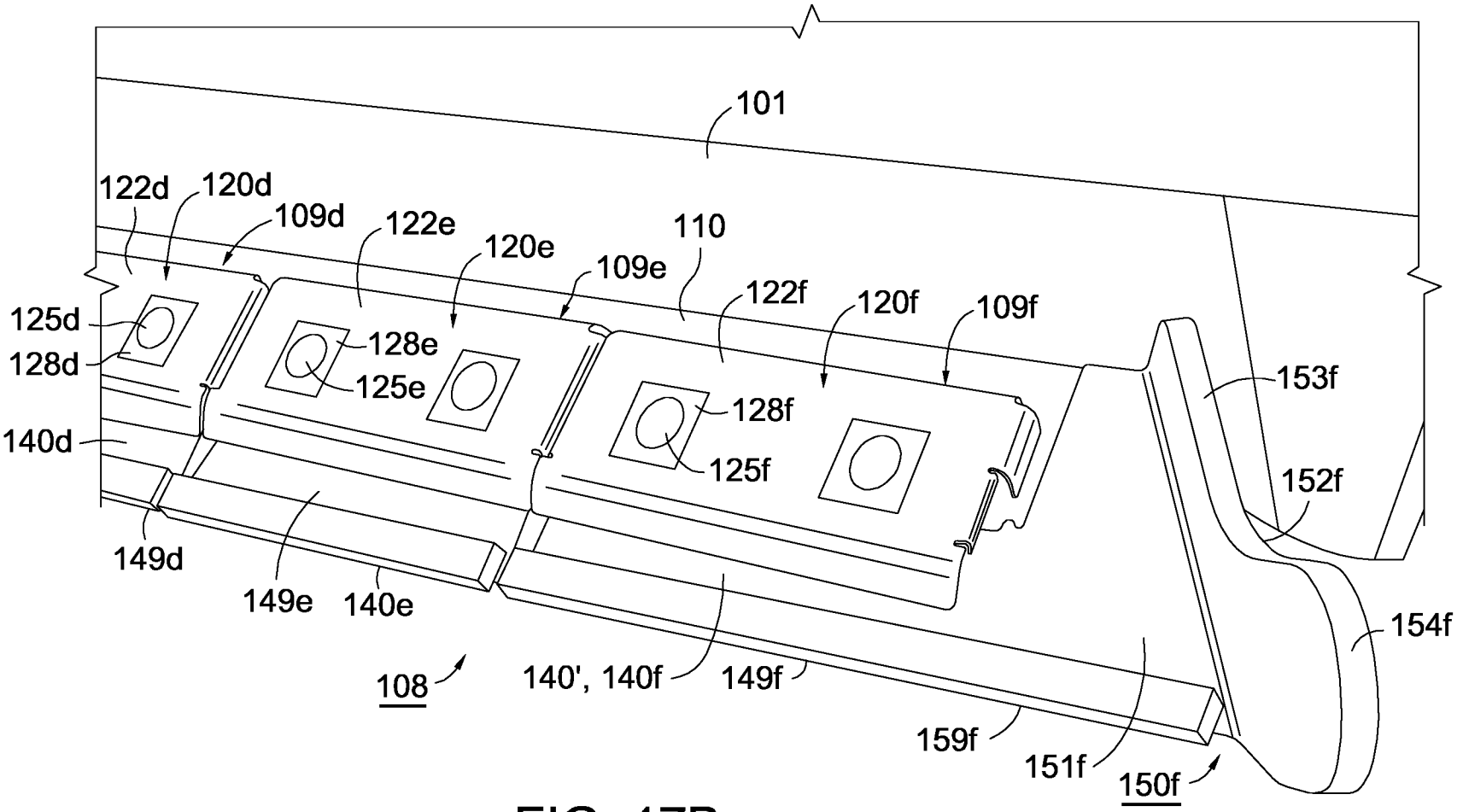
FIG. 17B shows an isometric view of a snow plow cutting edge device including a plurality of blade attachments, one of which is the end blade attachment having the nose piece shown in FIG. 17A.

FIG. 17B shows an example embodiment in which a blade 140*f* (similar to blade 140') having a nose piece 150*f* is installed in an end blade retainer 120*f* of an end snow plow blade attachment 109*f*, along with other blades 140*a-e* installed in other blade retainers 120*a-e* of other snow plow blade attachments 109*a-e* as part of snow plow cutting edge device 108 via adapter plate 110 (also refer to FIG. 16). Blade 140*f* having an integrated nose piece 150*f* goes in the corner of the snow plow to catch snow and any spill over from the plow. The nose piece 150*f* of blade 140*f* of end blade attachment 109*f* in this example embodiment provides an advantage over existing immovable snow plow nose pieces in that it can move up and down to better conform to variable road surfaces in a similar manner to the other blades 140*a-e* of the other blade attachments 109*a-e* of snow plow cutting edge device 108.

In addition to the above described needs and solutions of FIGS. 13-16 and 17A-17B, there is also a need for an improved snow plow blade that is better adapted for encountering raised obstacles in or on road surfaces. For example, it is common for existing snow plows to hit various raised iron or other obstructions, such as elongated bridge extension joints, which can cause major damage to the snow plow or some of its components.

Figure 18C:
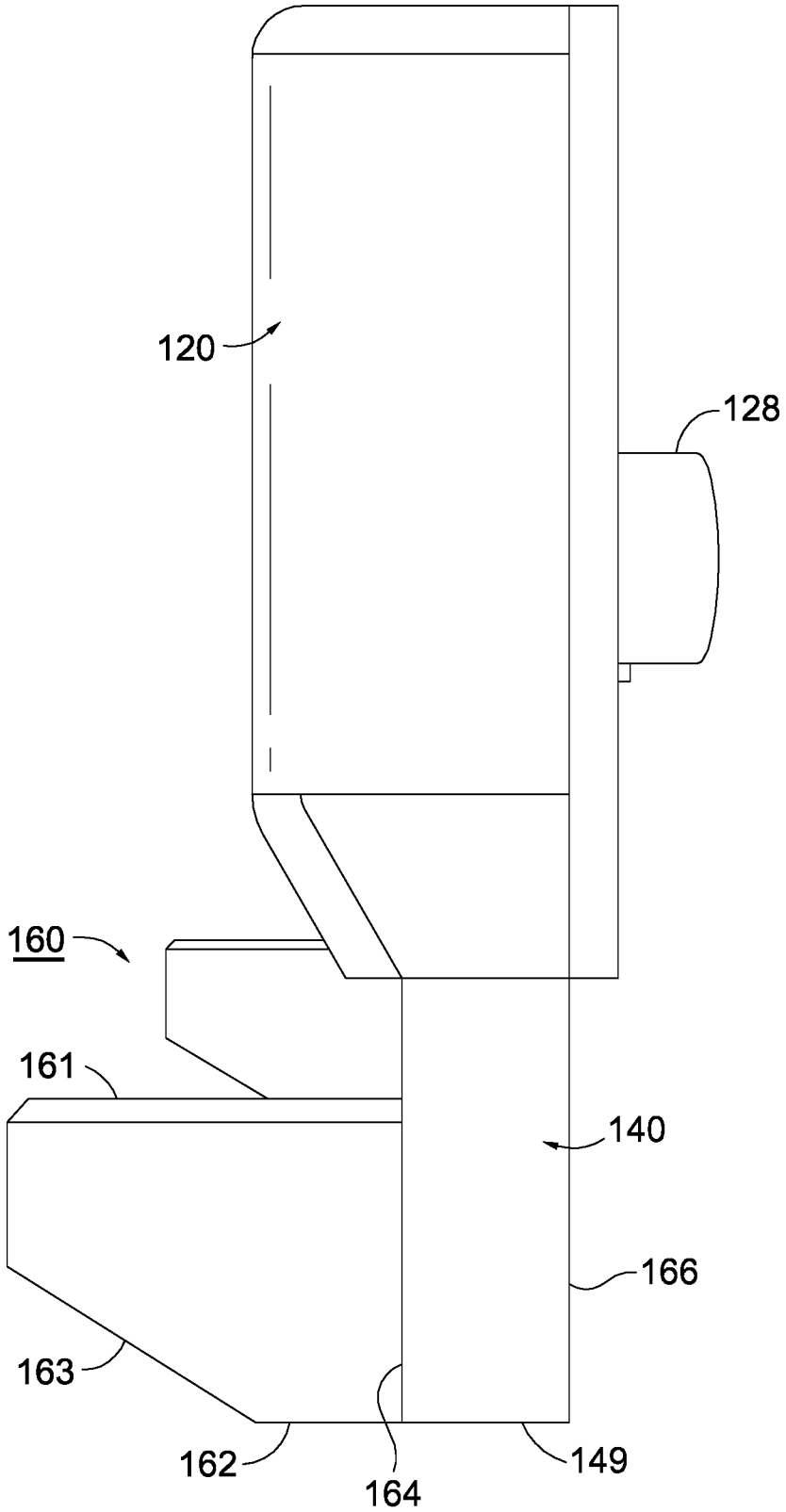
FIG. 18C is a side view of a snow plow blade attachment with the snow plow blade shown in FIGS. 18A-18B.

Therefore, according to another example embodiment shown in FIGS. 18A, 18B and 18C, snow plow blade 140 can be modified to include a pair of wing tips 160. Wing tips 160 may be welded or otherwise fixedly attached to front surface 164 of blade 140 at or near the bottom corners thereof which are at or near bottom edge 149. In some example embodiments, each wing tip 160 includes a protrusion 161 such as a block of material, which may be the same, similar to, or different from the material of blade 140. Protrusion 161 may be attached to side ends of blades 140 near bottom cutting edge 149, and extending forward from front surface 164 of blade 140. Protrusion 161 may have an optional bottom edge 162 that is flush with bottom cutting edge 149 with a tapered edge 163 extending therefrom. Tapered edge 163 may be an angled or curved edge that is directed upward away from the road surface. It should be appreciated that the specific shape of wing tips 160 (protrusion 161) as shown in FIGS. 18A, 18B and 18C is non-limiting and intended to be illustrative only. For example, in some other embodiments the corners of protrusion 161, bottom edge 162 and/or tapered edge 163 of wing tips 160 can be made rounded (instead of straight or squared) so that there are no hard corners that can potentially catch the road surface or other obstructions, in addition to having the upward-sloping tapered edge 163.

Wing tips 160 provide an advantage in that they will allow the blade sections to move up and down and ride over raised edge extending laterally across the road, such as bridge joints and manhole covers, for example, as well as other similar obstructions. Wing tips 160 allow blades 140 to ride over, and avoid getting caught, snagged, or otherwise hindered by these types of raised road elements. Wing tips 160 according to this exemplary embodiment can thus reduce, limit, or prevent damage to blades 140 themselves and/or other components of snow plow blade attachments 109.

However, it should be appreciated that snow plow blade wing tips 160 are entirely optional, and may have situational application depending on different road conditions where the particular snow plow will be used. Wing tips 160 may be use-case specific and may not be a standard feature on all blades 140 of blade attachments 109 of a given snow plow. It should also be appreciated that a given snow plow cutting edge device 108 could include one or more standard blades 140 without wing tips and one or more modified blades 140 with wing tips 160, if appropriate or desired, which could be installed in any one or more blade retainers 120 of any one or more blade attachments 109 (e.g., 109*a*-109*f*) along the length of adapter plate 110 of such cutting edge device 108.

From the foregoing, it will be seen that this invention is one well adapted to attain all the ends and objects hereinabove set forth together with other advantages which are obvious and which are inherent to the method and apparatus. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. As used herein, the terms "having" and/or "including" and other terms of inclusion are terms indicative of inclusion rather than requirement.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed is:

1. A snow plow blade attachment for connection to an adapter plate mountable to a moldboard of a snow plow, the snow plow blade attachment comprising:

a) a blade retainer including a front plate, a back plate, a top plate extending between the front plate and the back plate, a first bushing associated with first and second apertures defined in the front plate and the back plate, respectively, and a second bushing associated with respective third and fourth apertures defined in the front plate and the back plate, respectively;

b) a plurality of springs, wherein each of the plurality of spring includes a first end and a second end, wherein the first end of each of the plurality of springs is disposed against the top plate of the blade retainer;

c) a blade including:

first and second elongated openings defined therein, wherein the first elongated opening is configured to receive the first bushing, and wherein the second elongated opening is configured to receive the second bushing;

a top edge having a plurality of notches defined therein, wherein each of the plurality of notches are configured to receive the second end of a corresponding one of the plurality of springs, and a bottom edge configured for engaging a road surface during operation of the snow plow; and d) first and second fasteners configured to be positioned in the first and second bushings, respectively, to secure the blade attachment to the adapter plate so that the blade is movably secured between the front plate and the back plate of the blade retainer;

wherein the plurality of springs bias the blade toward the road surface so that the bottom edge maintains contact with the road surface;

the plurality of notches each include a bottom surface and two opposing side surfaces that are configured to receive a corresponding one of the plurality of springs, and each of the plurality of springs have a width that corresponds to a width between the two opposing side surfaces of the corresponding one of the notches to prevent lateral movement of the corresponding one of the plurality of springs relative to the blade.

2. The snow plow blade attachment according to claim 1, wherein each of the plurality of notches are configured to provide a tight fit for the corresponding springs received therein to support and limit lateral movement of the respective springs.

3. The snow plow blade attachment according to claim 2, wherein the blade further includes a nose piece extending from one side of the blade.

4. The snow plow blade attachment according to claim 2, wherein the blade includes a front side, and wherein the blade further includes a pair of wing tips extending from the front side of the blade.

5. The snow plow blade attachment according to claim 4, wherein each of the pair of wing tips includes a tapered edge that extends at an angle relative to the bottom edge away from the road surface.

6. A snow plow blade attachment for connection to an adapter plate mountable to a moldboard of a snow plow, the snow plow blade attachment comprising:

a) a blade retainer including a front plate, a back plate, a top plate extending between the front plate and the back plate, a first bushing associated with first and second apertures defined in the front plate and the back plate, respectively, and a second bushing associated with respective third and fourth apertures defined in the front plate and the back plate, respectively, wherein the front plate includes:

a spacer plate including first and second holes defined therein which are configured to receive the first and second bushings, respectively;

a middle portion including a bottom portion that is bent or angled toward the blade, wherein the first and second apertures are defined in the middle portion;

the top plate, wherein the top plate is perpendicular to the middle portion of the front plate;

a pair of side portions, wherein the side portions extend from opposite side edges of the middle portion and are positioned adjacent to respective side edges of the blade;

b) a plurality of springs, wherein each of the plurality of spring includes a first end and a second end, wherein the first end of each of the plurality of springs is disposed against the top plate of the blade retainer;

c) a blade including:

first and second elongated openings defined therein, wherein the first elongated opening is configured to receive the first bushing, and wherein the second elongated opening is configured to receive the second bushing, a top edge having a plurality of notches defined therein, wherein each of the plurality of notches are configured to receive the second end of a corresponding one of the plurality of springs and a bottom edge configured for engaging a road surface during operation of the snow plow, and d) first and second fasteners configured to be positioned in first and second bushings, respectively, to secure the blade attachment to the adapter plate so that the blade is movably secured between the front plate and the back plate of the blade retainer, wherein the plurality of springs bias the blade toward the road surface so that the bottom edge of the blade maintains contact with the road surface.

7. The snow plow blade attachment according to claim 6, wherein the top plate and the pair of side portions are integrated with the middle portion of the front plate.

8. The snow plow blade attachment according to claim 6, wherein the top plate and/or one or both of the side portions are separate and distinct relative to the spacer plate and the middle section of the blade retainer.

9. A blade retainer for a snow plow blade attachment for connection to an adapter plate mountable to a moldboard of a snow plow, the blade retainer comprising:

a) a front plate including first and second apertures defined therein;

b) a back plate including third and fourth apertures defined therein;

c) a top plate extending between the front plate and the back plate;

d) a first bushing associated with the first aperture and the third aperture; and e) a second bushing associated with the second aperture and the fourth aperture, wherein the first bushing and the second bushing are configured to receive first and second fasteners, respectively, and thereby secure the blade retainer to the adapter plate, wherein the first and second bushings are configured to be disposed in respective first and second elongated slots defined in a blade at least partially positioned between the front plate and the back plate, and wherein the top plate is configured to support a plurality of springs disposed within corresponding notches defined in in the blade and integrally formed with the front plate.

10. The blade retainer according to claim 9, wherein the front plate includes a bottom edge, wherein the back plate includes a bottom edge, and wherein the bottom edge of the front plate is aligned with the bottom edge of the back plate.

11. The blade retainer according to claim 9, further comprising a first side portion and a second side portion, and wherein the first side portion and the second side portion extend between respective side edges of the front plate and the back plate.

12. Blade retainer for a snow plow blade attachment for connection to an adapter plate mountable to a moldboard of a snow plow, the blade retainer comprising:

a) a front plate including first and second apertures defined therein;

b) a back plate including third and fourth apertures defined therein;

c) a top plate extending between the front plate and the back plate;

d) a first bushing associated with the first aperture and the third aperture; and e) a second bushing associated with the second aperture and the fourth aperture, wherein the first bushing and the second bushing are configured for receiving first and second fasteners, respectively, to secure the blade retainer to the adapter plate, wherein the first and second bushings are configured to be disposed in respective first and second elongated slots defined in a blade at least partially positioned between the front plate and the back plate, wherein the top plate is configured to support a plurality of springs disposed within corresponding notches defined in in the blade, wherein the front plate comprises:

a spacer plate including first and second holes defined therein which are configured to receive the first bushing and the second bushing, respectively;

a middle portion including a bottom portion that is bent or angled toward the blade;

a pair of side portions extending from opposite side edges of the middle portion;

wherein the first aperture and the second aperture are defined in the middle portion;

wherein the top plate is oriented perpendicular to the middle portion;

and wherein the pair of side portions are positioned adjacent to respective side edges of the blade.

13. The blade retainer according to claim 12, wherein the top plate and the pair of side portions are integrated with the middle portion of the front plate.

14. The blade retainer according to claim 12, wherein the top plate and/or one or both of the side portions are separate and distinct relative to the spacer plate and the middle section of the blade retainer.

15. The blade retainer according to claim 12, wherein the front plate, the back plate and the top plate enclose the blade on all sides except for a bottom edge of the blade.

16. A snow plow blade attachment for connection to an adapter plate mountable to a moldboard of a snow plow, the blade attachment comprising:

a) a blade retainer including a front plate, a back plate, a top plate extending between the front plate and the back plate, and a pair of bushings insertable through holes defined in the front plate and the back plate;

b) a plurality of springs each comprising a first end and a second end, wherein the first end of each of the plurality of springs is disposed against a top plate of the front plate of the blade retainer; and c) a blade comprising:

a pair of elongated openings defined therein, wherein each of the elongated openings are configured to receive one of the pair of bushings, wherein the pair of bushings are configured to receive a corresponding number of fasteners that operate to secure the blade retainer to the adapter plate;

a top edge having a plurality of notches defined therein, wherein each of the plurality of notches include a bottom surface and two opposing side surfaces, wherein each of the plurality of notches are configured to receive the second end of a respective one of the plurality of springs;

a bottom edge configured to engage a road surface during operation of the snow plow, wherein the springs bias the blade toward the road surface so that the bottom edge maintains contact with the road surface, and a nose piece extending from a side of the blade and configured to catch spill over from the snow plow, and wherein each of the plurality of springs comprise a width that corresponds to a width between the two opposing side surfaces of the corresponding one of the notches and thereby prevents lateral movement of the corresponding one of the plurality of springs relative to the blade.

17. A blade for a snow plow blade attachment adapted to be connected to an adapter plate mountable to a moldboard of a snow plow, the blade attachment includes a blade retainer including a front plate, a back plate, and a pair of bushings insertable through holes defined in the front plate and the back plate, and wherein the blade attachment further includes a plurality of springs, wherein each spring includes a first end and a second end, wherein the first end of each of the plurality of springs is disposed against a top portion of the front plate of the blade retainer, the blade comprising:

a front surface;

a back surface;

a pair of elongated openings extending between the front surface and the back surface, wherein each of the elongated openings receive one of the pair of bushings, wherein the pair of bushings receive a corresponding number of fasteners that operate to secure the blade retainer to the adapter plate;

a top edge having a plurality of notches defined therein, wherein each of the plurality of notches include a bottom surface and two opposing side surfaces, wherein each of the plurality of notches receive the second end of a respective one of the plurality of springs;

a bottom edge configured to engage a road surface during operation of the snow plow, wherein the springs bias the blade toward the road surface;

a pair of wing tips extending from the front surface of the blade to allow the blade to ride over obstacles protruding from the road surface;

wherein each of the plurality of springs comprises a width corresponding to a width between the two opposing side surfaces of the corresponding one of the plurality of notches to prevent lateral movement of the corresponding one of the plurality of springs relative to the blade.

18. The blade according to claim 17, wherein each of the wing tips includes a protrusion attached to opposite side ends of the blade adjacent the bottom edge; and the protrusion has a flat bottom edge and a slanted edge extending upward away from the road surface.

19. The blade according to claim 18, wherein the flat bottom edge and the slanted edge of the protrusion of each of the wing tips have rounded corners.

20. A blade retainer for a snow plow blade attachment for connection to an adapter plate mountable to a moldboard of a snow plow, the blade retainer comprising:

a) a front plate including first and second apertures defined therein, wherein the front plate includes:

a middle portion, wherein the first aperture and the second aperture are defined in the middle portion;

a top plate; and a pair of side portions extending from opposite side edges of the middle portion;

b) a back plate including third and fourth apertures defined therein, wherein the top plate extends between the front plate and the back plate;

c) a first bushing associated with the first aperture and the third aperture; and d) a second bushing associated with the second aperture and the fourth aperture, wherein the first bushing and the second bushing are configured for receiving first and second fasteners, respectively, to secure the blade retainer to the adapter plate, wherein the first and second bushings are configured to be disposed in respective first and second elongated slots defined in a blade at least partially positioned between the front plate and the back plate, wherein the top plate is configured to support a plurality of springs disposed within corresponding notches defined in in the blade, and wherein the top plate and the pair of side portions are coupled to the back plate to at least partially enclose the blade between the front plate and the back plate.

21. The blade retainer according to claim 20, wherein the top plate and the pair of side portions are welded to the back plate.

22. A blade retainer for a snow plow blade attachment for connection to an adapter plate mountable to a moldboard of a snow plow, the blade retainer comprising:

a) a front plate including first and second apertures defined therein, wherein the front plate includes a top edge, a first side edge, a second side edge;

b) a back plate including third and fourth apertures defined therein, wherein the back plate includes a top edge, a first side edge and a second side edge;

c) a top plate integrally formed with the top edge of the front plate and the top edge of the back plate;

d) a first side portion coupled with the first side edge of the front plate and the first side edge of the back plate; and e) a second side portion coupled with the second side edge of the front plate and the second side edge of the back plate, wherein the front plate, the back plate, the top plate, the first side portion, and the second side portion define a cavity configured to slidably receive a blade, wherein the first aperture and the third aperture are configured to receive a first fastening mechanism for mounting the blade retainer to the adapter plate, and wherein the second aperture and the fourth aperture are configured to receive a second fastening mechanism for mounting the blade retainer to the adapter plate.

23. A blade retainer for a snow plow blade attachment for connection to an adapter plate mountable to a moldboard of a snow plow, the blade retainer comprising:

a) a front plate including first and second apertures defined therein, wherein the front plate includes a top edge, a first side edge, a second side edge;

b) a back plate including third and fourth apertures defined therein, wherein the back plate includes a top edge, a first side edge and a second side edge;

C) a top plate coupled with the top edge of the front plate and the top edge of the back plate;

d) a first side portion coupled with the first side edge of the front plate and the first side edge of the back plate; and e) a second side portion coupled with the second side edge of the front plate and the second side edge of the back plate, wherein the front plate, the back plate, the top plate, the first side portion, and the first side portion define a cavity configured to slidably receive a blade, wherein the first aperture and the third aperture are configured to receive a first fastening mechanism for mounting the blade retainer to the adapter plate, wherein the second aperture and the fourth aperture are configured to receive a second fastening mechanism for mounting the blade retainer to the adapter plate, and wherein the front plate, the top plate, the first side portion, and the second side portion are integrally formed with one another.

24. The blade retainer according to claim 22, wherein the front plate includes a bottom edge, wherein the back plate includes a bottom edge, and wherein the bottom edge of the front plate is aligned with the bottom edge of the back plate.

25. The blade retainer according to claim 22, wherein the front plate includes a bottom edge, and wherein at least one of the first side portion and the second side portion extends from the top edge of the front plate to a location between the top edge and the bottom edge of the front plate.

26. The blade retainer according to claim 22, wherein the back plate includes a bottom edge, and wherein at least one of the first side portion and the second side portion extends from the top edge of the back plate to a location between the top edge and the bottom edge of the back plate.

27. A blade retainer for a snow plow blade attachment for connection to an adapter plate mountable to a moldboard of a snow plow, the blade retainer comprising:

a) a front plate including first and second apertures defined therein, wherein the front plate includes a top edge, a first side edge, a second side edge, and wherein the front plate includes a middle portion including a bottom end;

b) a back plate including third and fourth apertures defined therein, wherein the back plate includes a top edge, a first side edge and a second side edge, and wherein the back plate includes a bottom edge;

c) a top plate coupled with the top edge of the front plate and the top edge of the back plate;

d) a first side portion coupled with the first side edge of the front plate and the first side edge of the back plate; and e) a second side portion coupled with the second side edge of the front plate and the second side edge of the back plate, wherein the front plate, the back plate, the top plate, the first side portion, and the first side portion define a cavity configured to slidably receive a blade, wherein the first aperture and the third aperture are configured to receive a first fastening mechanism for mounting the blade retainer to the adapter plate, and wherein the second aperture and the fourth aperture are configured to receive a second fastening mechanism for mounting the blade retainer to the adapter plate, and wherein at least one of the first side portion and the second side portion extends from the top edge of the back plate to the bottom end of the middle portion and to the bottom edge of the back plate.

28. The blade retainer according to claim 27, wherein the front plate includes a bottom portion that extends from the bottom end.

29. The blade retainer according to claim 28, wherein the bottom portion extends from the bottom end at an angle of less than 45 degrees relative to the middle portion.

30. The blade retainer according to claim 28, wherein the bottom portion extends from the bottom end at an angle of greater than or equal to 45 degrees relative to the middle portion.

* * * * *